US006442803B1

(12) United States Patent
Foster et al.

(10) Patent No.: US 6,442,803 B1
(45) Date of Patent: Sep. 3, 2002

(54) METHOD OF PRODUCING BLENDS OF COTTON LINT

(75) Inventors: Raymond Keith Foster, 1029 NW. Birch La. P.O. Box 1, Madras, OR (US) 97741; Mark Jay Beason, Redmond, OR (US); Gayle Craft, Plains, TX (US)

(73) Assignee: Raymond Keith Foster, Madras, OR (US)

( * ) Notice: Subject to any disclaimer, the term of this patent is extended or adjusted under 35 U.S.C. 154(b) by 0 days.

(21) Appl. No.: 09/783,174

(22) Filed: Feb. 14, 2001

(51) Int. Cl.[7] ..... D01G 13/00
(52) U.S. Cl. ..... 19/145.5; 19/80 R
(58) Field of Search ..... 19/145.5, 62 R, 19/65 A, 65 R, 80 R, 85, 87, 90, 91, 93, 94, 81, 97, 97.5, 105, 144, 145.7; 209/606, 616; 700/142

(56) References Cited

U.S. PATENT DOCUMENTS 4,117,571 A * 10/1978 Prather ..... 19/80 R
4,244,082 A * 1/1981 Leifeld et al. ..... 19/145.5
4,479,285 A * 10/1984 Ragan ..... 19/80 R
4,497,085 A * 2/1985 Van Doorn et al. ..... 19/80 R
4,908,910 A * 3/1990 Pinto et al. ..... 19/145.5
5,025,533 A * 6/1991 Faas et al. ..... 19/145.5
5,121,841 A * 6/1992 Harrington et al. ..... 19/80 R
5,222,675 A * 6/1993 Stover ..... 209/616
5,282,141 A * 1/1994 Faas et al. ..... 19/105
5,329,668 A * 7/1994 Schlichter ..... 19/145.5
5,340,264 A * 8/1994 Quaeck ..... 198/750
RE35,022 E * 8/1995 Foster ..... 198/750.5
5,469,603 A * 11/1995 Stover ..... 19/80 R
5,934,445 A * 8/1999 Foster et al. ..... 198/750.5
6,108,872 A * 8/2000 Nichols et al. ..... 19/62 R

* cited by examiner

*Primary Examiner*—Danny Worrell
*Assistant Examiner*—Gary L. Welch
(74) *Attorney, Agent, or Firm*—Delbert J. Barnard

(57) ABSTRACT

A plurality of cotton boll modules are received by a cotton ginning plant from a plurality of cotton field locations. A sample of cotton modules is removed from each field lot. The sample and the field lot are identified and identification data associating the sample with its field lot is generated. Each field lot sample is separately processed to produce cotton lint. The cotton lint is assayed to determine a relative quality of the lint or the sample. The assay information from the several samples is used to establish a formula for blending cotton from a plurality of field locations to form a blend of a desired intermediate quality. The identification data is used for locating modules to be blended from the various field lots. The located modules are delivered to dispersers and the dispersers are used to disperse cotton boll clumps from the modules in amounts necessary to form the desired amount of the desired blend of cotton boll clumps. The cotton boll clumps are blended. The blended cotton boll clumps are then cleaned and ginned to form a cotton lint blend.

28 Claims, 18 Drawing Sheets

FIG.13
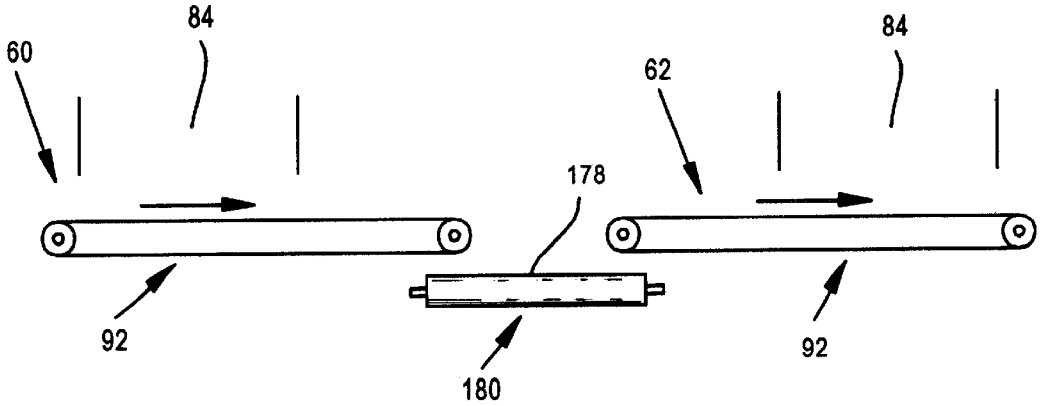
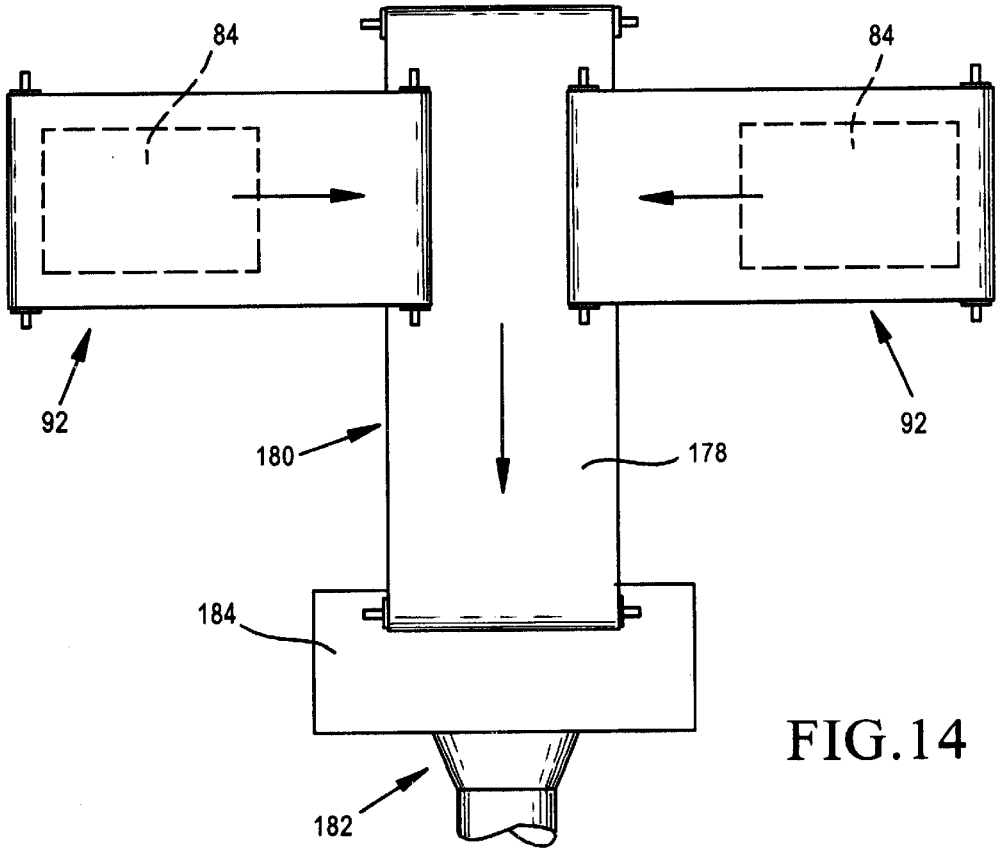
FIG.14

FIG.15
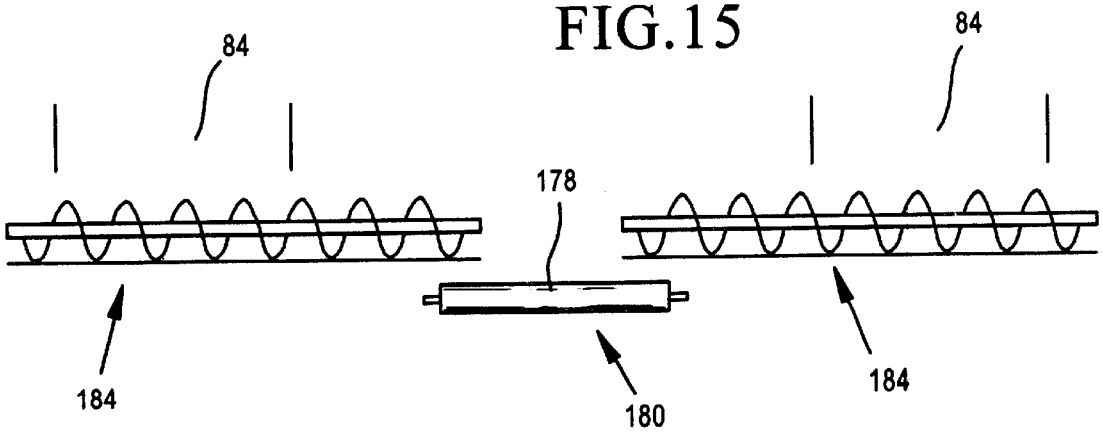
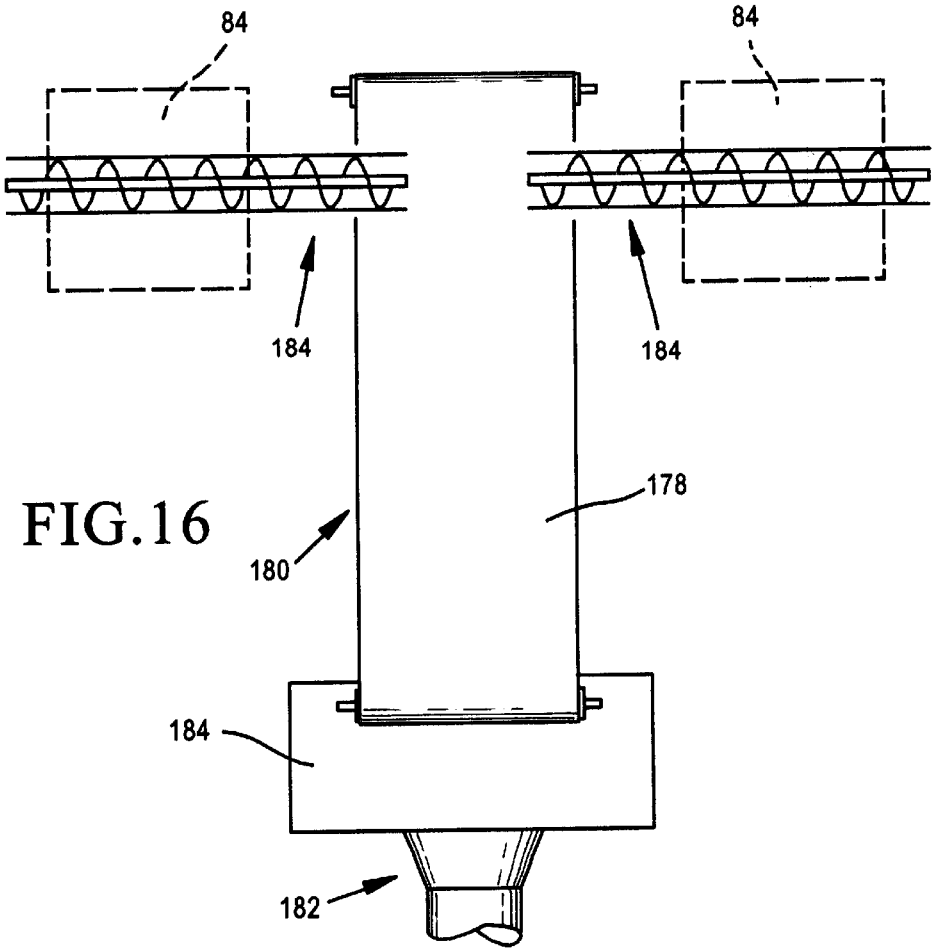
FIG.16

FIG.17
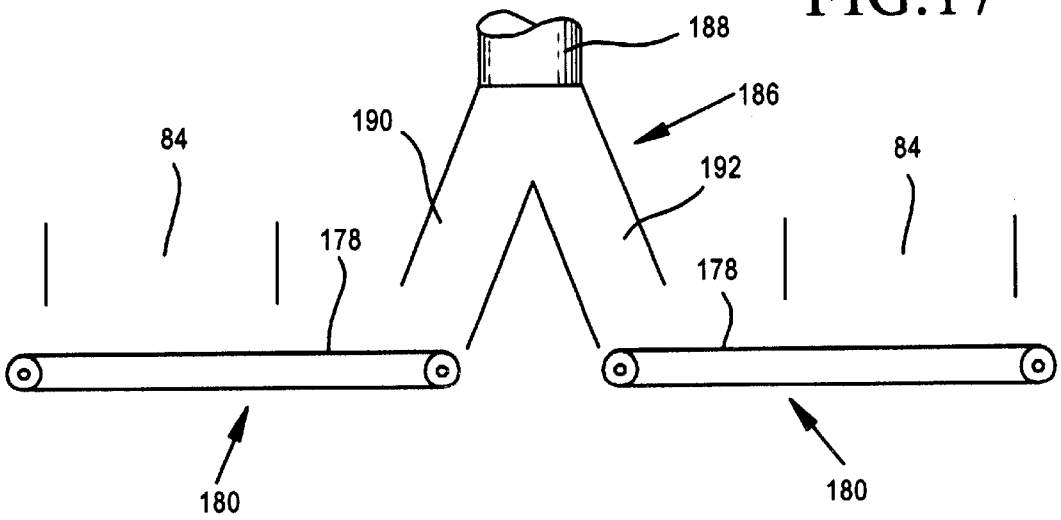
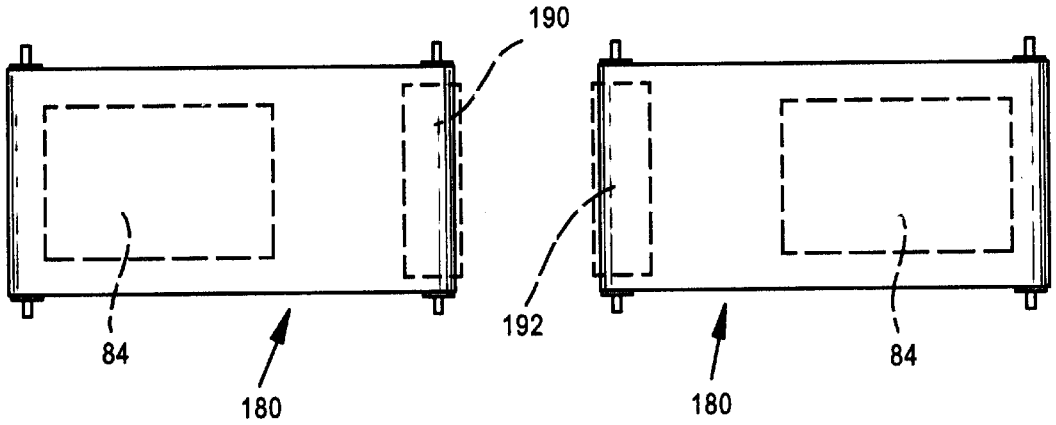
FIG.18

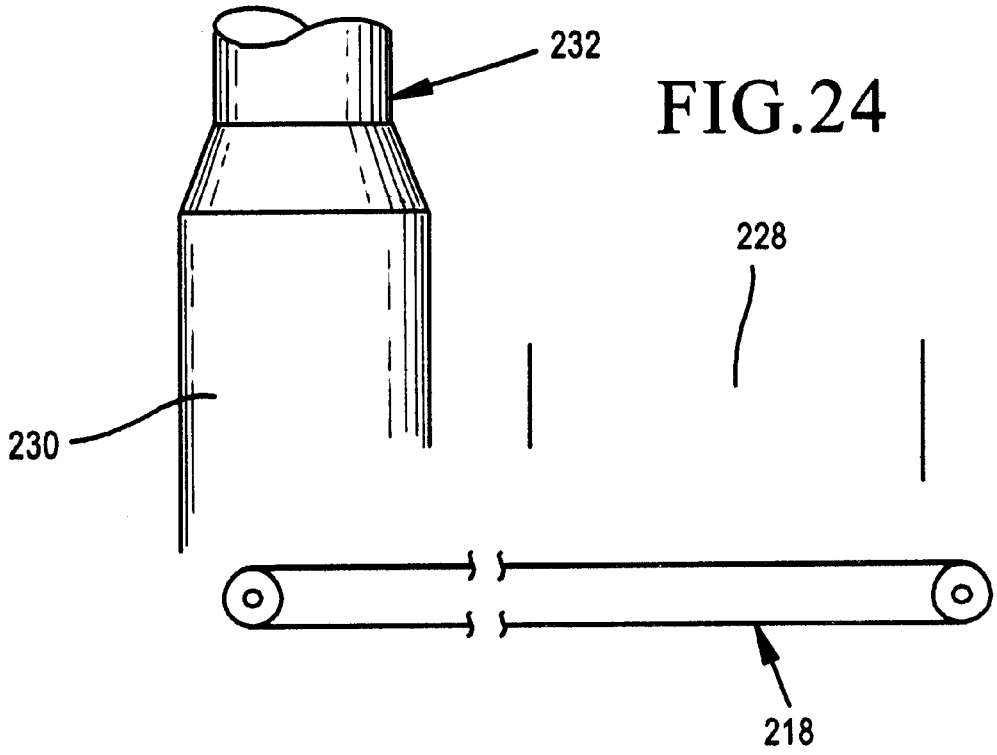
FIG.24
FIG.25
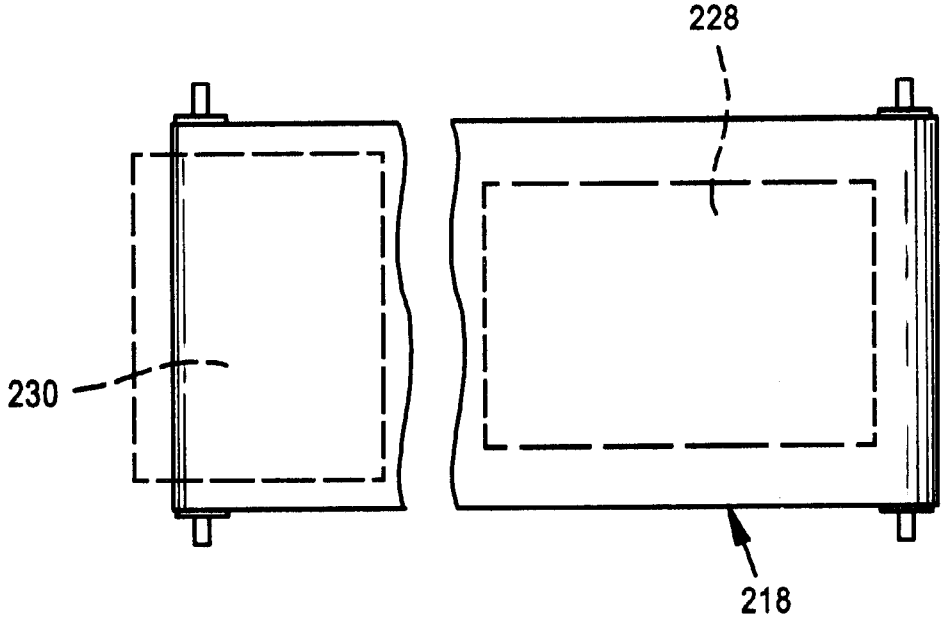

METHOD OF PRODUCING BLENDS OF COTTON LINT

TECHNICAL FIELD

This invention relates to the handling of cotton between the fields and the textile mills. More particularly, it relates to a method of operating a cleaning and ginning plant to produce blends of lint cotton for delivery to the textile mills.

BACKGROUND OF THE INVENTION

As known to those skilled in the cotton industry, cotton plants produce seedpods, known as cotton bolls, which contain the seeds. Seed hairs, or fibers, growing from the outer skin of the seeds, become tightly packed within the boll, which bursts open upon maturity, revealing soft masses of the fibers. These fibers are white to yellowish white in color, range from about 0.75 to about 1.5 inches in length and are composed of about 85–90% cellulose, a carbohydrate plant substance; five to eight percent water; and four to six percent natural impurities.

Cotton is harvested when the bolls open. In the fields, the cotton bolls are tightly compressed into large modules which are transported from the fields to processing plants. In the processing plants, the modules are mechanically dispersed into clumps and then the fibers are separated from the seeds and are cleaned and then are further processed, ultimately into yarns.

It is known to disperse the cotton boll modules by use of a stack of rolls that include fingers which rotate into an advancing end of a cotton module, to tear loose clumps of the bolls from the module as they rotate. The stack of rolls is termed a disperser and it is common to use conveyors for delivering the cotton modules to the disperser. Example disperser systems are disclosed by the following United States Patents: U.S. Pat. No. 4,497,085, granted Feb. 5, 1985 to Donald W. Van Doorn, James B. Hawkins, Tommy W. Webb and William A. Harmon, Jr.; U.S. Pat. No. 5,121,841, granted Jun. 16, 1992, to Keith Harrington and Donald Rogers; U.S. Pat. No. 5,222,675, granted Jun. 29, 1993, to Jimmy R. Stover; U.S. Pat. No. 5,340,264, granted Aug. 23, 1994, to Manfred W. Quaeck and U.S. Pat. No. 5,469,603, granted Nov. 28, 1995, to Jimmy R. Stover. These patents show examples of the conveyors which have been used, or proposed, for delivering the cotton modules to the disperser. The present invention is not limited to any particular type of conveyor. However, a reciprocating slat conveyor is advantageous and preferred. Example reciprocating slat conveyors that are suitable are disclosed by U.S. Pat. No. 5,934,445, granted Aug. 10, 1999, to Raymond Keith Foster, Randall M. Foster and Kenneth A. Stout, and U.S. Pat. No. RE 35,022, granted Aug. 22, 1995, to Raymond Keith Foster.

Cotton fibers may be roughly classified into three main groups, based on staple length (average length of the fibers in a cotton module) and appearance. The first group includes the fine, lustrous fibers with staple length ranging from about 1 to about 2.5 inches and includes types of the highest quality—such as Sea Island, Egyptian and Pima cottons. Least plentiful and most difficult to grow, long-staple cottons are costly and are used mainly for fine fabrics, yarns and hosiery. The second group contains the standard medium-staple cotton, such as American Upland, with staple length from about 0.5 to 1.3 inches. The third group includes the short-staple, coarse cottons, ranging from about 0.375 to 1 inch in length, used to make carpets and blankets, and to make coarse and inexpensive fabrics when blended with other fibers. Within each group, the quality of the fibers can vary depending on such things as where the cotton is grown. It is desirable to blend the lower quality fibers with higher quality fibers to produce an acceptable quality blend of fibers.

It is an object of the present invention to provide a method for blending cotton clumps as they are removed from the cotton modules. The clumps of bolls are mixed together to form the blend and then the blend is further processed to separate the fibers from the seeds, etc.

It is customary to disperse, clean and gin the cotton modules as they are brought from the fields to the ginning plant. Herein the term "field lot" is used to mean a common quality of cotton usually from a particular field, or a region of a particular field, or two or more regions or fields in which the quality of the cotton is substantially the same. It is common practice to harvest the field lots and bring the modules to the ginning plant and there disperse the modules as they are received and collect and clean and gin the cotton clumps. At the end of the ginning operation the cotton lint is packed into bales and the bales are marked so as to identify the type and/or quality of cotton lint that each bale contains. Eventually the bales are delivered to textile mills where they are formed into thread that is used for making cloth. Presently, when it is desired to blend together two or more different kinds or qualities of cotton lint, the blending is done at the textile mill. Measured quantities of cotton lint are removed from bales that differ in kind and/or quality and the lint from the several bales is mixed or blended together and then the blend is processed to form the thread.

The co-pending applications of Raymond Keith Foster and Mark Jay Beason, Ser. No. 09/654,144, filed Sep. 1, 2000, and entitled Method And Apparatus For Mixing Textile Fibers And Particulate Material, and their later filed copending application Ser. No. 09/782,571, filed Feb. 13, 2001, and entitled Method And Apparatus For Blending Textile Fibers, disclose methods and apparatus for blending cotton boll clumps at the disperser station, with blending continuing in the cleaning and ginning plant, so as to produce a blend of cotton lint at the ginning plant that are delivered to the textile mills. The present invention utilizes some of the method and apparatus concepts that are disclosed in those applications.

BRIEF SUMMARY OF THE INVENTION

The process-of the present invention includes receiving a plurality of cotton boll modules from a plurality of cotton field locations, to provide a plurality of field lots. A sample of cotton modules is selected from each field lot. Each sample and the field lot from which it came are identified and information data is generated associating each sample with its field lot. The field lot samples are separately processed to produce cotton lint. The cotton lint is then assayed to determine a relative quality. of the lint in each field lot sample. The assay information is used to establish a formula for blending cotton boll clumps from a plurality of field lots of different quality in order to form a cotton boll blend of a desired intermediate quality. The identification data is used for locating modules to be blended in storage. The located modules are introduced into dispersers and the dispersers are used to disperse cotton boll clumps from the modules in amounts necessary to form the desired amount of the desired blend of cotton boll clumps. The cotton boll clumps that are dispersed from the modules are mixed to form a blend of cotton boll clumps. The blend of cotton boll clumps is then cleaned and ginned so as to form a cotton lint blend.

It is within the scope of the present invention to store the identified field lots of cotton boll modules until the modules are to be selected to form a desired cotton lint blend. The selected modules are removed from storage and are then dispersed to form cotton boll clumps. The cotton boll clumps are blended, cleaned and ginned to form a desired cotton lint blend. Preferably, this is done in response to the receipt by the ginning plant of an order for a desired cotton lint blend from a customer. The cotton lint blend may be delivered to the textile mill customer, substantially immediately following its production so that storage is not necessary.

In a preferred embodiment of the invention, the modules are dispersed at a dispersing station that is located at the ginning plant. A conveyor is used for delivering and further blending the cotton boll clumps as they are moved from the disperser station to at least one cleaning unit and at least one cotton gin in the ginning plant.

Preferably, at least one pair of first and second confronting dispersers are provided at the disperser station.

Each disperser has an input side and an output side. The output sides face each other on opposite sides of a mixing zone. The first and second dispersers are operated while a first cotton boll module is conveyed against the input side of the first disperser and a second cotton boll module is fed against the input side of the second disperser. The first and second dispersers are operated so that each will disperse cotton boll clumps from its module and deliver them into the mixing zone in admixture with cotton boll clumps from the other dispenser of the pair. The mixture of cotton boll clumps is collected and is conveyed away from the dispenser station into and through the cleaning and ginning operation.

In preferred form, a conveyor (e.g. an airstream conveyor) is used for conveying the blend of cotton boll clumps during at least of a part of their travel from the disperser station to the cleaning and ginning operation, so that the cotton boll clumps are further blended (e.g. fluidized) as they are being conveyed.

The present invention includes storing the identified field lots of cotton boll modules until it is desired to form a particular cotton lint blend. Then, cotton boll modules are selected from the identified lots in storage and are moved to the dispersing station and are then dispersed and/or mixed.

Preferably, each disperser is provided with an infeed conveyor. The selected modules are removed from storage and are placed onto the infeed conveyors. Then, the conveying speeds of the infeed conveyors are controlled so as to control the dispersion rate of the cotton boll clumps and thus the content of the blend.

According to a desired aspect of the invention, cotton boll clumps from diverse field lots are further mixed and blended as they are moved from the disperser station to cleaning units and cotton gins in the ginning plant. Also, there is further mixing and blending of the cotton boll clumps in the cleaning units. There is still more mixing and blending of the cotton boll clumps in the cotton gin.

The present invention includes positioning more than two dispensers at the dispenser station, each having an input side and an output side. Cotton boll clumps are dispersed from each cotton boll module and the clumps are mixed and blended before being conveyed to the cleaning and ginning operation.

It is also within the scope of the invention to dispensers that are positioned side-by-side. The dispersers are used to disperse cotton boll clumps from-diverse modules. The clumps are then collected and are mixed together to form a blend of cotton boll clumps.

A further aspect of the invention is to use the cotton lint produced by processing the field lot samples to establish a market price for each field lot. Then, this market price information is used to help establish a formula for blending cotton from the various field lots to produce a desired blend to be sent to a textile mill.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWINGS

Like reference numerals and letters refer to like parts throughout the several views of the drawing, and:

FIG. 13 is a side elevational diagram showing two outfeed conveyors positioned to discharge onto the third conveyor;

FIG. 14 is a top plan view of the conveyor assembly of FIG. 13, showing the third conveyor discharging in to the inlet of a fluid conveyor;

FIG. 15 is a view like FIG. 13, but showing the use of helical screw-type outfeed conveyors;

FIG. 16 is a view like FIG. 14, but showing helical screw-type outfeed conveyors;

FIG. 17 is a view like FIGS. 13 and 15, but showing the two feed conveyors positioned to convey cotton clumps to an inlet for a fluid conveyor;

FIG. 18 is a view like FIGS. 14 and 16, but of the conveyor assembly shown by FIG. 17;

FIG. 24 is a view like FIG. 13, with respect to a disperser shown by FIG. 22;

FIG. 25 is a view like FIG. 14, but with respect to a disperser of the type shown by FIG. 22;

DETAILED DESCRIPTION OF THE INVENTION

Figure 1:
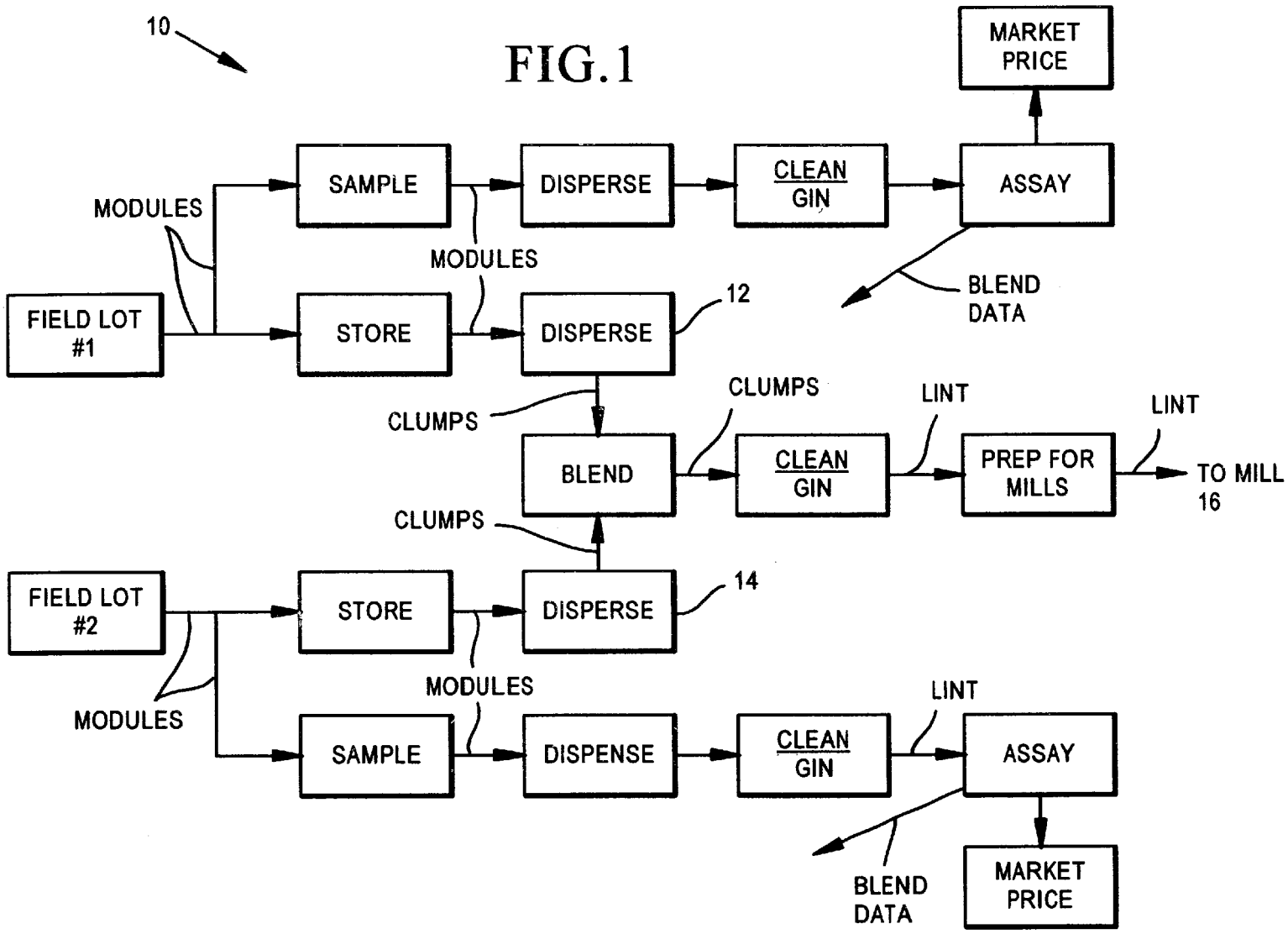
FIG. 1 is a flow diagram of a cotton handling system of the present invention, starting with in cotton fields and ending in the lint receiving mills.

FIG. 1 is a flow diagram of some aspects of the present invention. The term "field lot" is used to identify a location or source of a particular grade or kind of cotton. At times, the different field lots will come from different fields that are spaced geographically apart. At other times, the different field lots may come from different field locations at a single geographical location. If the cotton characteristics are the same, cotton from two different fields or two different field regions may produce a single field lot. For purposes of this invention, it is differences in the cotton that determines the different field lots.

By way of example, FIG. 1 shows two different kinds or grades of cotton being processed to form a blend. It is to be understood, however, that the invention is not limited to only two sources of cotton, or two field lots, but may be used to blend cotton coming from three or more field lots.

Referring to FIG. 1, the cotton bolls are harvested at each location and are formed into modules while in the fields. The modules are then moved from the fields to the ginning mill 10 which is represented by the remainder of the diagram. Modules from field lot number 1 are brought to the ginning plant 10. A sample of the modules is immediately processed while the remainder of the modules from field lot number 1 are put into storage. For example, one out of every ten modules might form the sample whereas the remaining nine out of each ten modules goes into storage. Preferably, the storage is provided at the ginning plant or at least at a convenient distance from the ginning plant. Preferably also, the storage is under control of the ginning plant operation.

According to the invention, the sample is dispersed to form cotton boll clumps. In the ginning plant, the cotton boll clumps are cleaned and ginned to form lint. The lint is assayed for the purpose of developing identifying indicia representing the kind and quality of cotton that came from field lot number 1. It is also used to determine a market price for the particular cotton that came from field lot number 1. The identifying indicia will become data that will be used to determine various blends of the cotton from field lot number 1 with other cotton of a different kind and/or quality from another location (e.g. field lot 2).

The sample modules and the remaining modules from field lot number 1 are marked so that at a later time the identifying indicia can be used to locate additional modules in storage corresponding to the sample modules. The same procedure that has been described is followed with respect to the modules that were received from field lot number 2, and each other field lot that is handled by the ginning operation. After the cotton lint samples from the various cotton lots have been assayed, the assay information is used to develop a formula for use in forming a blend. An example formula would be two parts cotton from field lot number 1 to be mixed with one part cotton from field lot number 2. Or, equal amounts of cotton may be obtained from three different field lots and processed in the ginning plant 10 to produce a blend of cotton lint to be delivered to a textile mill.

When it is desired to start blending the cotton, the assay information developed from the samples is used for generating a blending formula. The identification indicia is also used for identifying the cotton modules in storage that are to be processed and blended. These modules are then delivered from storage to the ginning plant 10. For example, let it be assumed that each module from field lot number 1 will be mixed or blended with a module from field lot number 2. The modules are moved from storage to dispensers that are apart of the ginning plant 10. FIG. 1 shows modules from field lot number 1 being moved from storage to a disperser 12 and modules from field lot number 2 being moved from storage to disperser 14. As will hereinafter be described, cotton clumps produced by the dispersers 12, 14 are blended and the cotton clump blend is first cleaned and then ginned in the ginning plant 10 to produce a cotton lint blend that is eventually delivered to a textile mill. This makes it unnecessary for the textile mill to have to do any blending. It also permits an advantageous operation of the ginning plant 10. For example, a textile mill may place an order with the ginning plant 10 for a particular cotton lint blend. Following receipt of the order, the cotton gin operator selects and processes the two or more kinds or qualities of cotton that together will make up the blend. The cotton lint blend may be transported from the ginning plant 10 to the mill 16 substantially immediately after it is produced. At the present time, unblended cotton lint is baled at the cotton gin plant and the bales are stored until they are ordered by a textile mill. As a part of the present invention, the cotton lint blend may be delivered from the ginning machines into transporters that carry it in bulk form to the textile mills. This would eliminate the cost of forming the lint into bales and the cost of storing the bales.

As earlier stated, the market price may be used for calculating the blending formula. For example, high-grade cotton having a high market price can be mixed with a lower grade cotton having a lower market price to produce an intermediate grade cotton having an intermediate market price.

Figure 2:
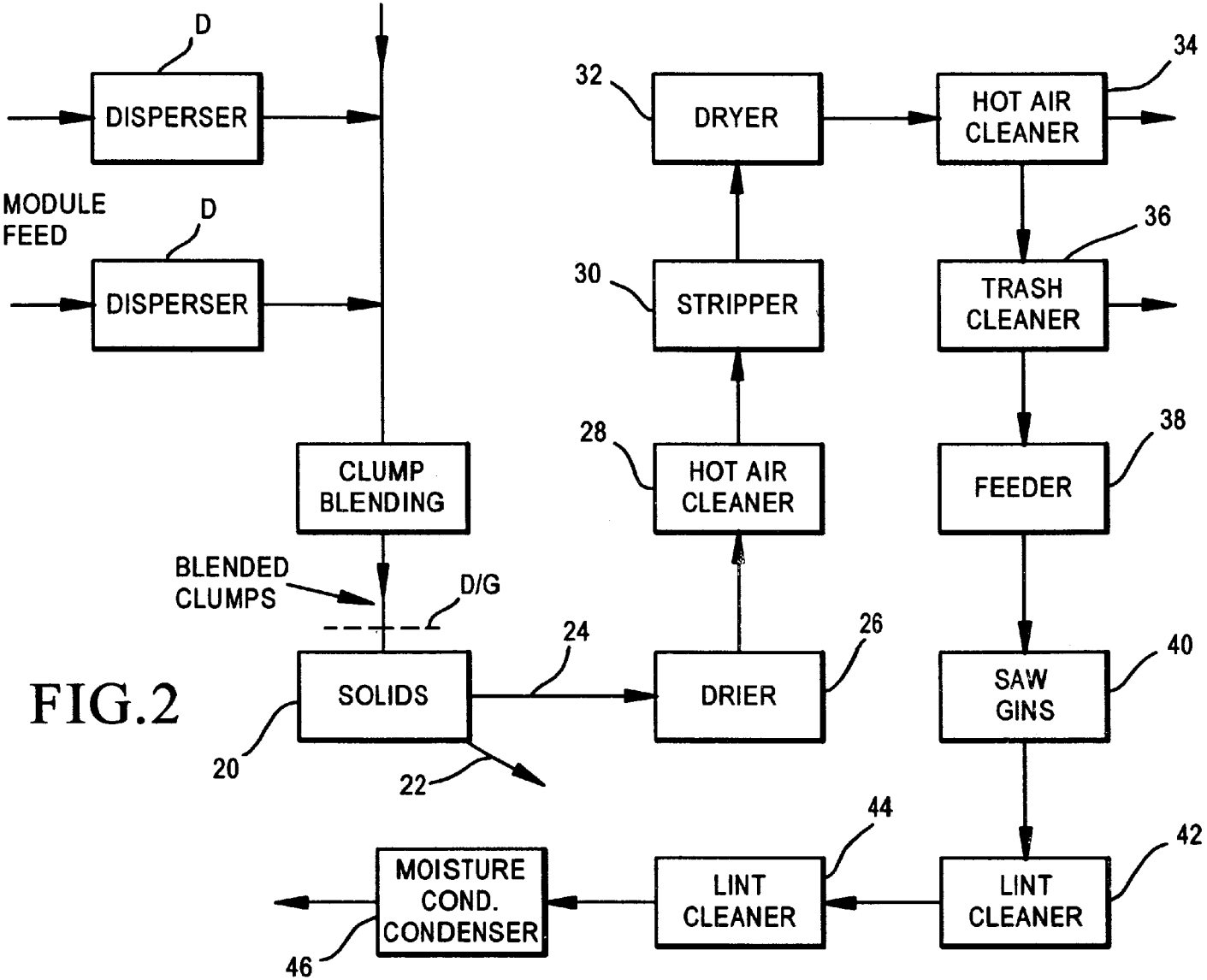
FIG. 2 is a flow diagram starting with the modules being fed to dispersers and continuing to and through a cleaning and ginning operation.

FIG. 2 is a flow diagram of a ginning system that includes aspects of the invention. D/G identifies a dividing line between the disperser operation and the ginning operation. As will hereinafter be described, the ginning operation includes cleaning procedures in addition to the actual ginning.

The prior art practice has been to deliver cotton modules to a disperser located at a disperser station that is at the gin mill. The disperser or dispersers are used to disperse the cotton boll modules into cotton boll clumps. These clumps are then delivered into the ginning system, starting at boundary line G/G. Most commonly, the modules are dispersed one at a time. The dispersers are moved relative to stationary modules. Or, the modules are feed into the dispersers by use of various types of conveyor equipment. As previously described, U.S. Pat. No. 5,222,675; U.S. Pat. No. 5,469,603 and U.S. Pat. No. 5,934,445 each discloses using a reciprocating slat conveyor for feeding the modules into the dispersers.

As described above, in the practice of the present invention, the cotton boll clumps are mixed together upstream of the boundary line D/G so that it is blended cotton boll clumps that are delivered into the cleaning and ginning system.

Referring to FIG. 2, two dispersers D are illustrated. However, it is to be understood that more than two dispersers can be used.

Preferably, but not necessarily, the dispersers are used in confronting pairs so that the cotton boll clumps will be admixed as they leave the dispersers and fly into the mixing zone between the dispersers. In the confronting-disperser embodiments, the first mixing or blending of the cotton boll clumps occurs as a part of the dispersing operation. The clumps are then fed into an airstream conveyor. When a plurality of dispersers are used in parallel, the initial mixing or blending of the dispersed fibers occurs in the airstream conveyor section that leaves the dispersers D, or mechanical conveyor sections downstream of the dispersers D. As previously mentioned, measured quantities of different qualities of cotton boll clumps or other textile fiber clumps are mixed or blended to produce a blend of a quality that is somewhere between the lowest quality fibers selected and the highest quality fibers selected. Careful calculations are made so that the fiber clump mix delivered into the cleaning and ginning operation will produce blended lint of a desired quantity and quality. As previously mentioned, the feed rate of the various infeed conveyors can be regulated so as to vary the quantity of each quality of fiber that is added to the blend or mix. For example, if only two qualities of textile fiber clumps are mixed, it might be desirable to mix them fifty-fifty (50/50).

In such case, the infeed conveyors will be operated to deliver the cotton modules 18 into the dispersers at the same rate of speed. Or, it might be desirable to mix together two quantities of fiber clumps from one module with one quantity of fiber clumps from a second module. This can be easily done by operating the infeed conveyors for the modules so that the infeed conveyor for the first quality modules will disperse the fiber clumps at twice the rate of the fiber clumps that are being dispersed from the other module. Fiber clumps from three qualities of fiber clump modules can be blended. And, fiber clumps from four or more qualities of fiber clump modules can be blended. The quantity and quality of the resulting blend or mixture can be regulated by regulating the feed rate of the infeed conveyors and hence the dispersion rate of the fiber clumps from the various modules.

As discussed above, the fiber clumps are ultimately picked up by an airstream conveyor and delivered by such conveyor into the cleaning and ginning plant, i.e. beyond boundary D/G. The equipment shown in FIG. 2 downstream of the boundary line D/G is equipment that already exists in the prior art. This portion of the flow diagram represents the more sophisticated flow diagram that is illustrated in a brochure produced by the Lummus Corporation, and entitled "The Gentle Ginning System." A copy of this brochure has been supplied to the United States Patent and Trademark Office for inclusion in the prosecution history of this patent.

In FIG. 2, a rock and boll separator 20 receives the blend of cotton boll clumps from the dispersers and removes at least some of the rocks out through path 22 and delivers the remaining portion of the mixture through path 24 to a tower dryer 26. The fiber blend then moves on to a hot air cleaner 28 and from the hot air cleaner 28 onto a stripper 30 in which sticks and leaves are removed. The effluent of stripper 30 moves on to another dryer 32 where it is heated and moisture is removed. The effluent from dryer 32 moves on to another hot air cleaner 34. The effluent of the hot air cleaner 34 moves on to a trash cleaner 36. The effluent of the trash cleaner 36 moves to a feeder 38 which moves the fiber blend into saw gins 40. The effluent of the saw gins 40 moves on to a series of lint cleaners 42, 44. The effluent of lint cleaner 44 moves on to a moisture conditioning condenser 46.

After passing through the moisture conditioner condenser 46, the fiber blend may be balled and the bales may then be moved into storage or on to a customer. Or, the fiber blend may be collected in a truck/trailer box, for example, or other transporter, and delivered to a customer in an unbaled condition.

FIGS. 3–27 are identical to FIGS. 1–26 in the aforementioned application Ser. No. 09/782,571, filed Feb. 13, 2001, and entitled Method And Apparatus For Blending Textile Fibers. The contents of that application, and the contents of the earlier filed application Ser. No. 09/654,144, filed Sep. 1, 2000, and entitled Method And Apparatus For Mixing Textile Fibers And Particulate Materials are hereby incorporated herein by reference. FIGS. 3–27 will now be described.

A part of the present invention is that the fiber clumps that are moved past boundary D/G into the cleaning and ginning plant is already blended so that additional blending of the fiber lint does not have to be done by the customer who receives the lint.

Figures 3, 4:
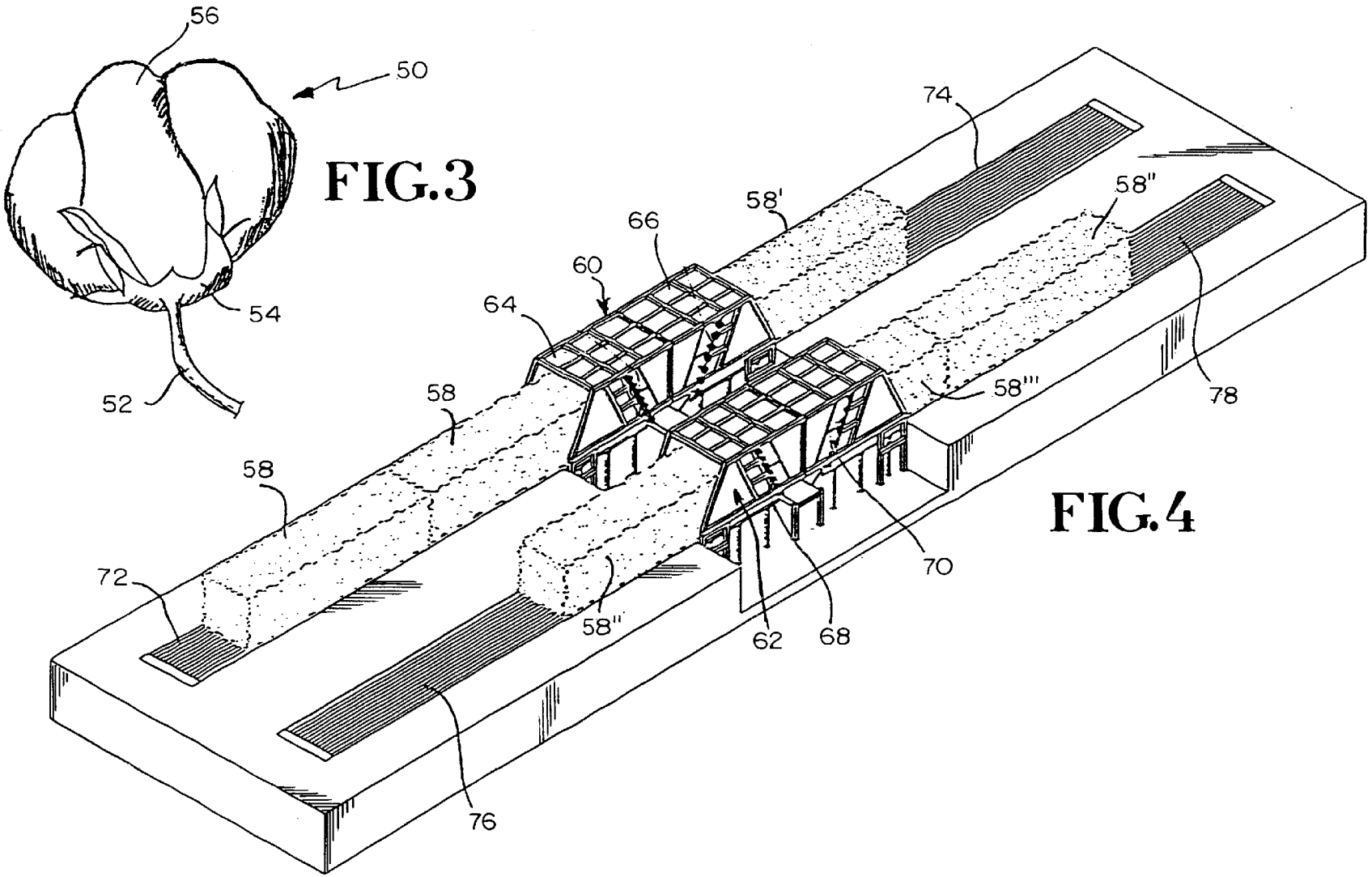
FIG. 3 is a pictorial view of a mature cotton boll, showing how it appears when harvested.
FIG. 4 is a pictorial view of a first example apparatus that adapted for dispersing clumps of cotton bolls from a plurality of cotton modules and mixing them together for delivery to the next stage of processing, such view being taken from above and looking towards the top, one side and one end of the apparatus.

FIG. 3 is a pictorial view of a single cotton boll 50 substantially as it appears at harvest time. The boll 50 comprises a stem 52, a base 54 connected to the stem 52 and a ball of seed hairs, or fibers, growing from the outer skin of seeds that are within the boll 50. In a manner that is well known in the art, the cotton bolls 50 are removed from the cotton plant and are tightly compressed into large modules 58, 58', 58", 58'" that are removed from the field and transported to the processing plant 10.

FIG. 4 shows a disperser station at the processing plant 10. This disperser station comprises a pair of disperser tunnels 60, 62 each including a pair of confronting dispersers 64, 66 and 68, 70. Each disperser, 64, 66, 68, 70 is provided with its own infeed conveyor 72, 74, 76, 78. In the illustrated system, the infeed conveyors 72, 74, 76, 78 are reciprocating slat conveyors.

Figure 5:
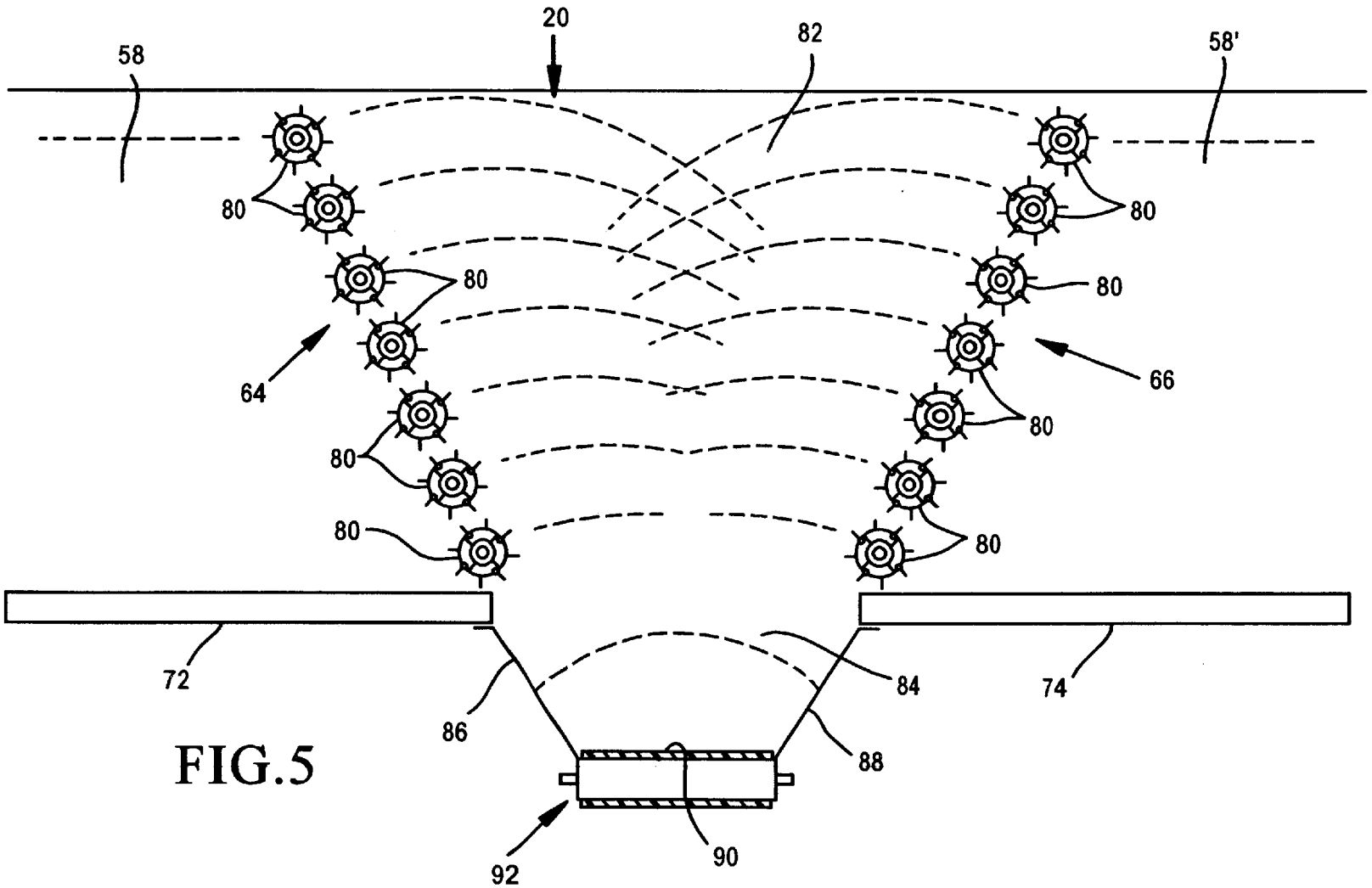
FIG. 5 is a diagrammatic sectional view through the center region of the apparatus shown by FIG. 4, showing a mixing zone formed by and between two dispersers, and an output conveyor below the mixing zone.

FIG. 5 is a longitudinal sectional view of disperser tunnel 60 and its two dispersers 64, 66. In FIG. 5, the structure is somewhat schematically shown as the constructional details of the tunnel 60 is not particularly important to the present invention. FIG. 5 shows infeed conveyors 72, 74 positioned and arranged to feed the modules 58, 58', 58", 58'" into the input sides of the dispersers 64, 66, respectively. In this embodiment, the dispersers 64, 66 are identical and each comprises a plurality of disperser rolls 80. In each disperser 64, 66, the bank of rolls 80 lean to the rear from vertical. The lean angle is about thirty degrees (30°) as illustrated. A mixing zone 82 in the shape of an inverted trapezoid is defined by and between the two dispersers 64, 66 and below the top of the disperser tunnel 60. Mixing zone 82 includes a lower portion 84 situated below the conveyors 72, 74 and above the upper run 90 of an outfeed conveyor 92. Mixing zone portion 84 includes sidewalls 86, 88 that slope downwardly from the conveyors 72, 74 to the upper run 90 of the conveyor 92.

Figure 6:
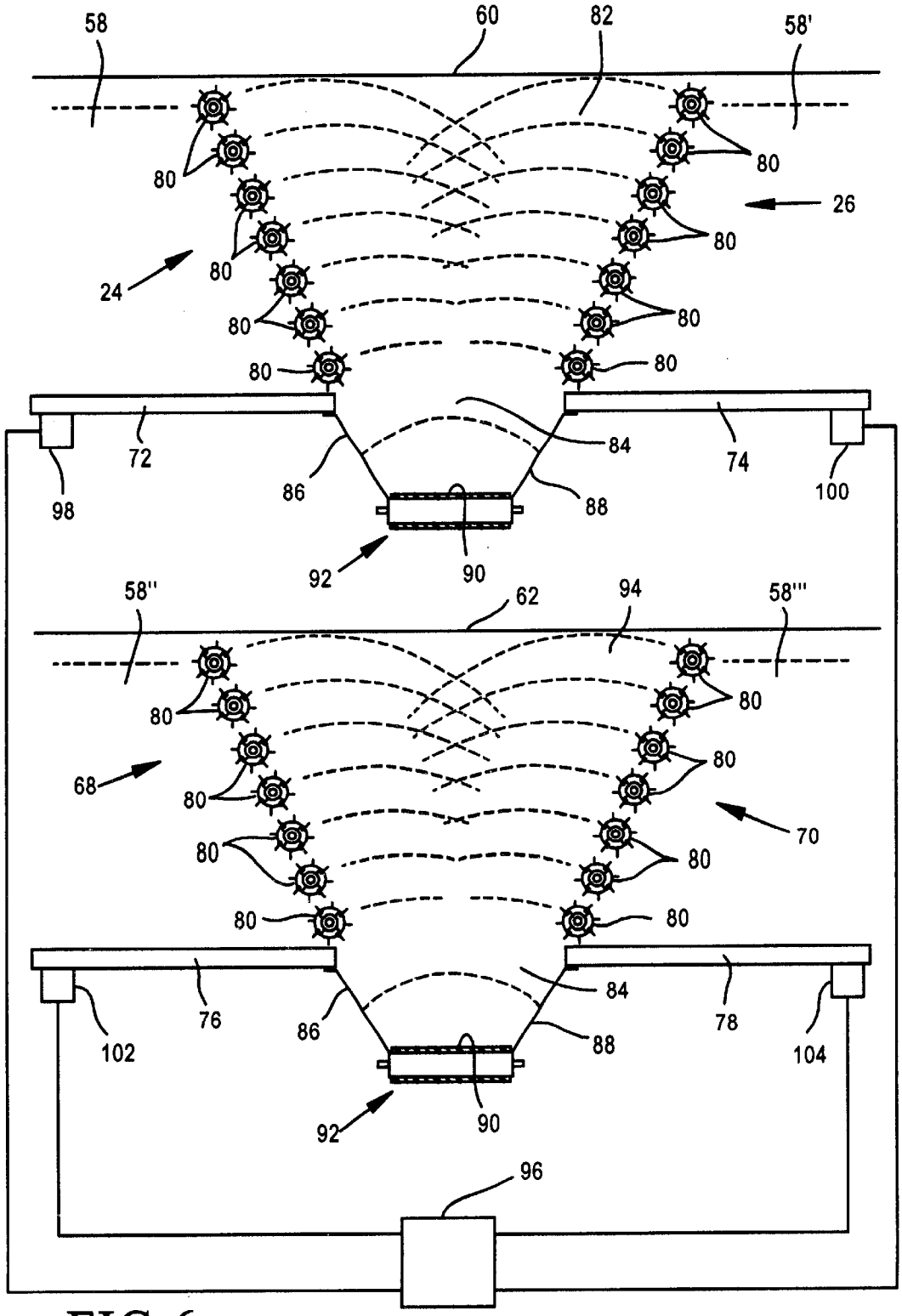
FIG. 6 is a view similar to FIG. 5, but showing two pairs of dispersers, a mixing zone between the dispersers of each pair, and including a schematic diagram of a computer controlled system for controlling the speed rate of the conveyors that deliver the cotton modules to the dispersers.

FIG. 6 shows a schematic of the disperser tunnel 62 below the schematic of the disperser tunnel 60. In FIG. 6, a mixing zone 94 is shown between the two dispersers 68, 70 and below the top of the mixing tunnel 62. Mixing zone 94 may be in series with mixing zone 82 and it may share the same outfeed conveyor 92 and the same sidewalls 86, 88.

At times, it may be desirable to use a single disperser (e.g. disperser 64) in a single disperser tunnel (e.g. tunnel 60), in which case the associated conveyor (e.g. conveyor 72) will be operated to move modules 58 into the dispersing tunnel and against the rolls 80 of the disperser 64.

Preferably, when a single disperser is-used, a baffle is positioned at the center of the disperser tunnel 60. Each disperser tunnel 60, 62 may be constructed in two longitudinal halves. Preferably, the two tunnel parts are connected together and a slot is provided in the top of the assembly where the two parts meet. The slot leads into vertical slideways that are positioned to collect opposite side edge portions of a baffle (not shown). A top plate may extend along the upper edge of the baffle. One or more handles may be secured to the top plate. In use, when it is desired to use only a single disperser, e.g. disperser 64, in a single disperser tunnel, e.g. tunnel 60, a workman need only pick up the baffle by use of the handle or handles H. The lower edge of the baffle can be dropped into the slot provided at the top of the tunnel. Then, the baffle may be allowed to move downwardly under the influence of gravity until the top plate is on top of the disperser tunnel, overlying the top and the slot and portions of the tunnel top that immediately border the slot. Whenever it is desired to use both dispersers at once, the workman need only grab the handle or handles and pull the baffle up out of the slideways and set it to one side. Of course, other ways may be used for providing a baffle at the center of the mixing zone. Baffle B is illustrated in both U.S. Ser. No. 09/654,144 and the application entitled Method And Apparatus For Blending Textile Fibers.

When the baffle is in place, the fiber clumps that are being thrown into the mixing zone by the disperser that is operating will strike the baffle and then drop downwardly onto the upper run 90 outfeed conveyor 92.

As will hereinafter be described in greater detail, rotation of the disperser rolls 80 will move fingers into the module 58 that will dislodge clumps of fibers from the front end of the module 58. As the fingers move into, then through, and then out from the module 58, they form the clumps and then throw the clumps into the chamber 82. The clumps then fall by gravity onto the upper run 90 of the outfeed conveyor 92. The outfeed conveyor 92 then moves the clumps on to the next station in the processing plant. Herein, the term "cotton boll clumps" includes a single cotton boll, a portion of a single cotton boll, a plurality of cotton bolls, and one or more cotton bolls stuck together by themselves or with any portion or portions of one or more additional cotton bolls. Hereinafter, the apparatus and method will sometimes be described by referring to cotton bolls and cotton boll clumps by way of example.

Referring again to FIG. 5, at times it may be desired to remove cotton boll clumps from two modules 58, 58' at the same time, by operating both conveyors 72, 74 at the same time. Conveyor 72 is operated to move a module 58 into the input of disperser 64 while conveyor 74 is operated to move a module 58' into the input of disperser 66. When this is done, the cotton clumps from the two modules 58, 58' are mixed together in the mixing zone 82. In FIG. 5, broken lines are used to show the travel paths of the cotton boll clumps. Mixing occurs as the cotton boll clumps are propelled into the mixing zone 82 so it can be said that each disperser 64, 66 removes cotton boll clumps from its module 58, 58' and discharges them into the mixing zone 82 into admixture with the cotton boll clumps from the other dispenser 64, 66. When both conveyors 72, 74 and both dispersers 64, 66 are being operated, a blend of cotton boll clumps is formed in the mixing zone 82. This blend drops onto the upper run 90 of the outfeed conveyor 92.

As will be appreciated, the two conveyors 72, 74, can be operated at either substantially the same feed rate or at different feed rates. When operating them at substantially the same feed rate, the blend will comprise approximately 50% cotton boll clumps from module 58 and 50% cotton boll clumps from module 58'. Or, the feed rate of the conveyors 72, 74 may be different. For example, conveyor 72 may be operated to cause travel twice as fast as conveyor 74. In this event, the blend or mixture will comprise two parts cotton boll clumps from module 58 and one part cotton boll clumps from module 58'.

Referring again to FIG. 6, it may be desirable to mix together cotton boll clumps from three grades or types of module. For example, conveyors 72, 74 and 76 may be operated at the same time, each at substantially the same feed rate or at different feed rates. In this mode of operation, a baffle will be inserted between disperser 68, 70. The cotton boll clumps that are dispersed from disperser 68 will strike the baffle and then fall down and are deposited onto the blend of cotton boll clumps from dispersers 64, 68 that is on the upper run 90 of the conveyor 92. The system also permits the mixing together of cotton boll clumps from four distinct modules. This is done by utilizing all four conveyors 72, 74, 76, 78 for simultaneously feeding four modules 58, 58', 58", 58'", each with a different quality content, for example. Operation of conveyers 72, 74 and dispersers 64, 66 will admix cotton boll clumps from modules 58, 58'. They will drop down onto the upper run 90 of the conveyor 92. Operation of conveyors 76, 78 and dispersers 68, 70 together will admix cotton boll clumps from modules 58", 58'". This mixture will drop on the mixture of cotton boll clumps from modules 58, 58' which is already on the upper run 90 of the conveyor 92.

FIG. 6 shows a schematic diagram of a control system that includes a programmed computer 96 that is adapted to send control signals to feed control devices 98, 100, 102, 104-associated with the conveyors 72, 74, 76, 78. The control system disclosed in the aforementioned U.S. Pat. No. 5,934,445 includes a is programmable processor or computer and circuit components for varying the feed rate of the conveyor. It is within the skill of the art for a programmer to adapt the processor 96 so that it can be used for controlling the feed rates of the four conveyors 72, 74, 76, 78. The processor 96 can be programmed to select how many of the conveyors 72, 74, 76, 78 will be used at a given time, and the feed rate of each conveyor. It can also be programmed to turn the dispersers 64, 66, 68, 70 on and off, and also control the speed rate of the rollers 80.

Keith Manufacturing Company of 401 N.W. Adler, Madras, Oreg. 97741, makes a conveyor known as the "Running Floor II®" unloading system or unloader. This system controls the feed rate of the conveyor by controlling the output of the pump that delivers hydraulic fluid to the hydraulic cylinders that move the conveyor slats. The pump output is controlled by controlling revolutions per minute of the tractor motor that drives the pump.

In the system of FIG. 6, the conveyors 72, 74, 76, 78 can be Running Floor II® conveyors. The processor 96 can be programmed to vary the drive input to the pump or in another suitable way, vary the flow rate of hydraulic fluid to the hydraulic cylinders that move the conveyor slats.

Various ways may be used to determine the feed rate of fiber clumps into the mixing zones. For example, it can be calculated from knowing the cross sectional dimensions of the module and the conveyor speed. Also, sensors may be provided along the path of travel of each module and used to determine movement of a particular part of the module over a particular amount of time. Each module may be provided with a mark on its side or top and the sensors may be positioned to monitor the position of this mark. The information received from the sensors can then be fed to the control system, as a feedback system, and used for changing the speed rate of the conveyor.

FIGS. 7–11 show a preferred construction of the disperser roll 80, also termed the "spike roll". This construction is quite simple but yet provides a very sturdy, durable roller. In preferred form, roller 80 includes an elongated tubular core 110 that extends substantially the full length of the main body of the roll. Core 110 is mounted for rotation by a live shaft 112 having end portions 114, 116 that extend axially outwardly of the opposite ends of the core 110. The core tube 110 may be supported on the member or members that provide the live shafts 114, 116 in any suitable manner, such as by use of disks or spiders that project radially outwardly from the members 114, 116 to the core tube 110. Members 114, 116 may be opposite end portions of a continuous member that extends all the way through the core tube 110. Or, they may be shorter members that are connected to the opposite end portions of the tubular core member 110.

The roll is divided into a plurality of sections by radial disks. In the illustrated embodiment, four disks 118, 120, 122, 124 are used. They divide the roll 80 into three sections that may be of substantially the same length or their lengths may vary to some extent. The disks 118, 120, 122, 124 may have a circular outline and may include a circular center opening through which the core tube 110 extends. The disks 118, 120, 122, 124 may be welded to the core tube 110.

The live shaft end portions 114, 116 are mounted for rotation in bearings. Shaft end portion 116 is connected to a suitable drive device for rotating the shaft portion 116, and hence, the roll 80. Bearing support systems and drive systems for disperser rolls are known in the prior art and do not per se form a part of the present invention.

Figure 8:
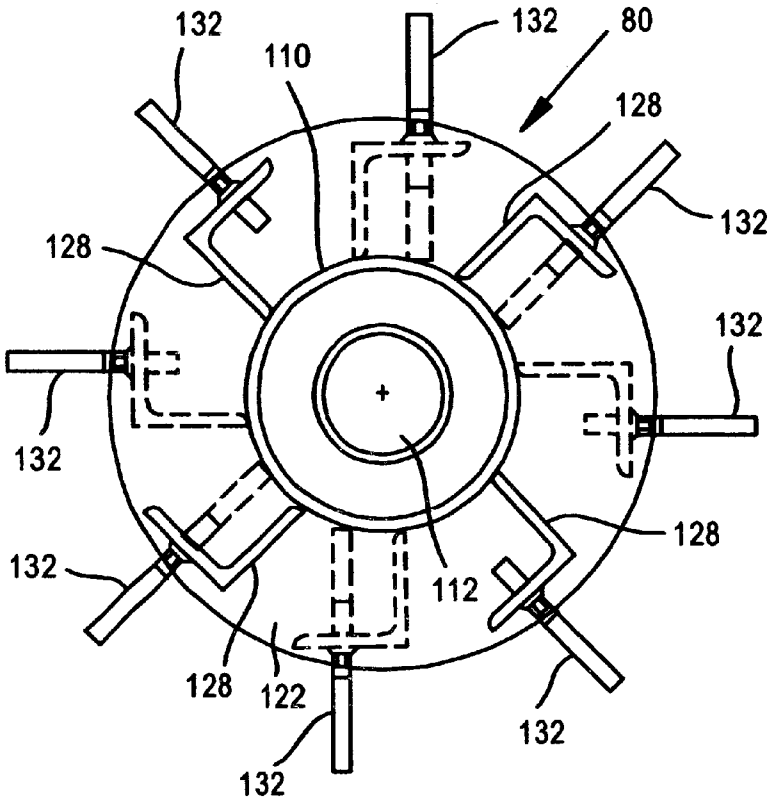
FIG. 8 is a sectional view taken substantially along line 8—8 of FIG. 10.
Figure 7:
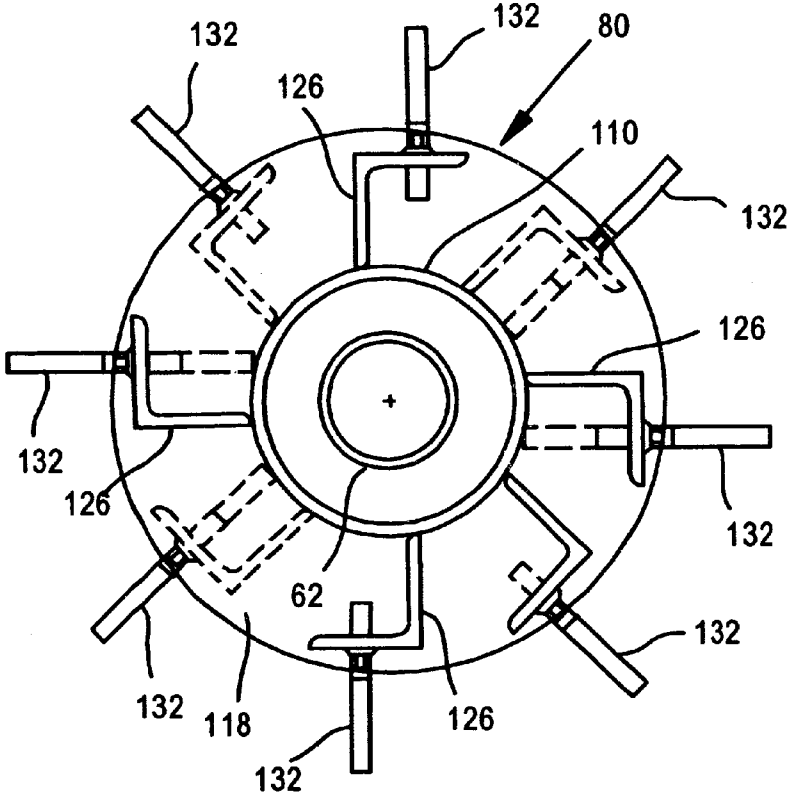
FIG. 7 is a sectional view taken substantially along line 7—7 of FIG. 10.
Figure 9:
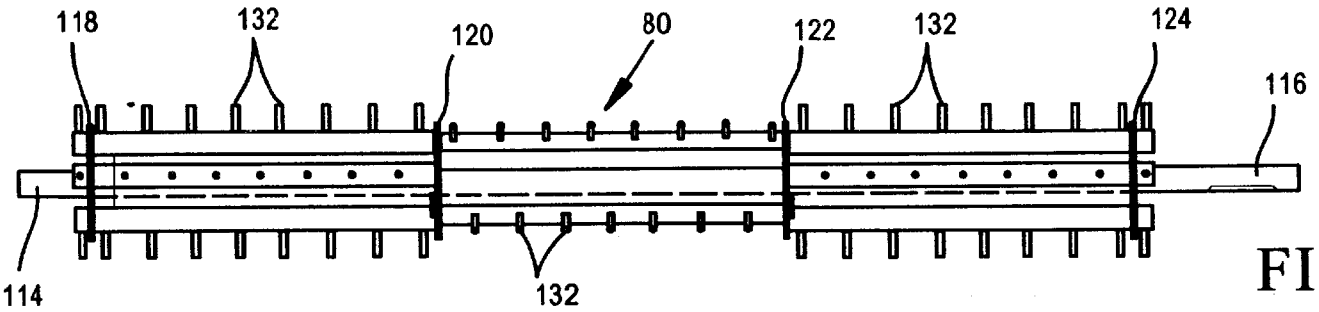
FIG. 9 is a side elevational view of one of the disperser rollers.
Figure 10:
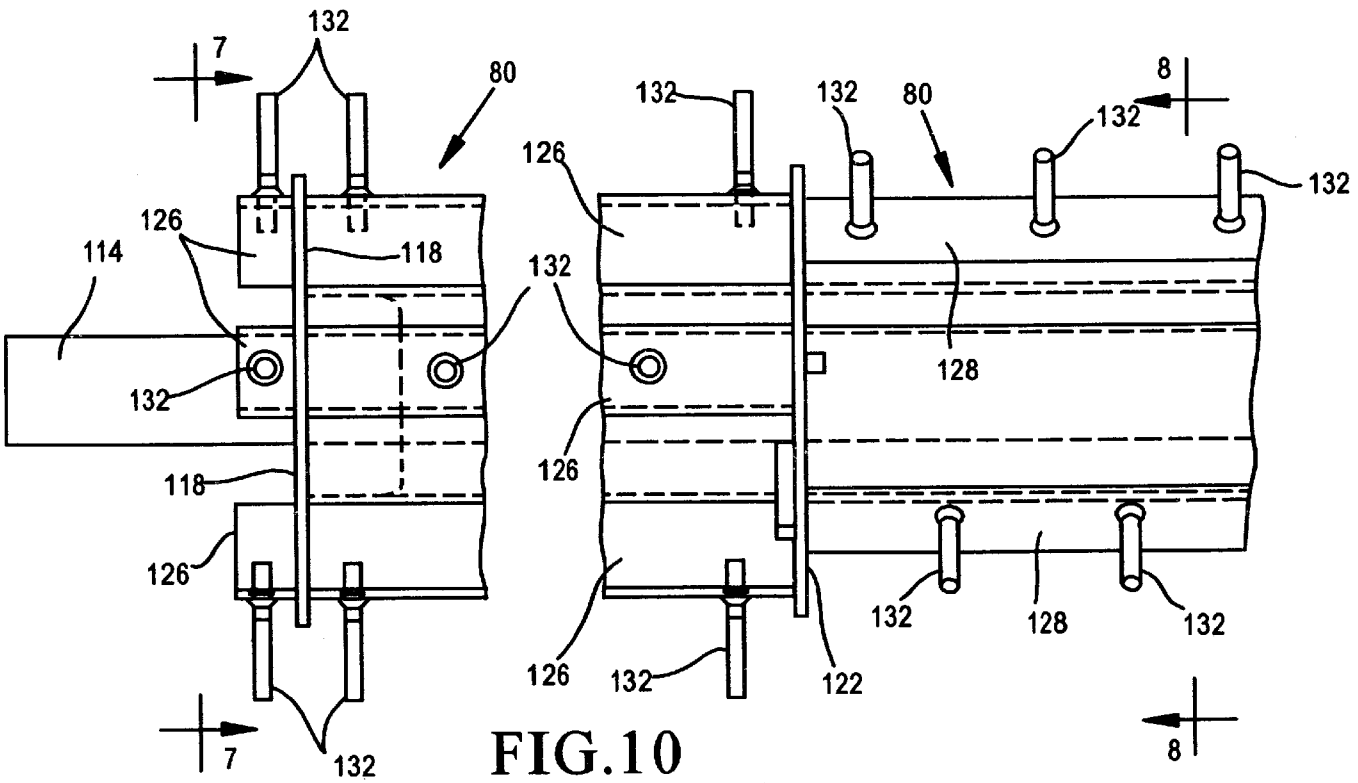
FIG. 10 is an enlarged scale fragmentary view of the roller shown by FIG. 9.

According to the present invention, a plurality of elongated tooth support members 126, 128, 130 are spaced around the tubular core, as shown by FIGS. 7 and 8. By way of typical and therefore non-limitive example, there are four members 126, four members 128, and four members 130. As shown by FIGS. 9 and 10, the two support members for each section are angularly spaced in position from the two support members of the adjacent section. In FIG. 9, the two support members 126 are shown at north, east, south and west positions. In FIG. 10, the two support members are shown in northeast, southeast, southwest and northwest positions. The two support members 130 are in axial alignment with the two support members 126. In other words, they are also in north, east, south and west positions and the 126, 128 are in the positions shown by FIGS. 9 and 10.

In preferred form, each tooth support member 126, 128, 130 is a length of angle iron. The angle iron members 126, 128, 130 are positioned such that they present an inner leg that preferably contacts the core tube 110 and an outer leg. The outer leg is substantially perpendicular to the inner leg and extends chordwise of the disks 118, 120, 122, 124. The inner leg is perpendicular to the outer leg but does not extend radially. The opposite ends of the two support members 126, 128, 130 are welded or otherwise firmly connected to the disks 118, 120, 122, 124.

Each tooth support member 126, 128, 130 supports a plurality of teeth or "spikes" 132 that are detachably connected to the outer leg of the tooth support member 126, 128, 130. The teeth or spikes 132 may be in the form of rods provided with a threaded connection 134 where they are connected to the tooth support members 126, 128, 130. As will be apparent, the angular staggering of the tooth support members 126, 128, 130 results in an angular staggering of the teeth 132 in the center section relative to the teeth 132 in the two end sections.

Figure 11:
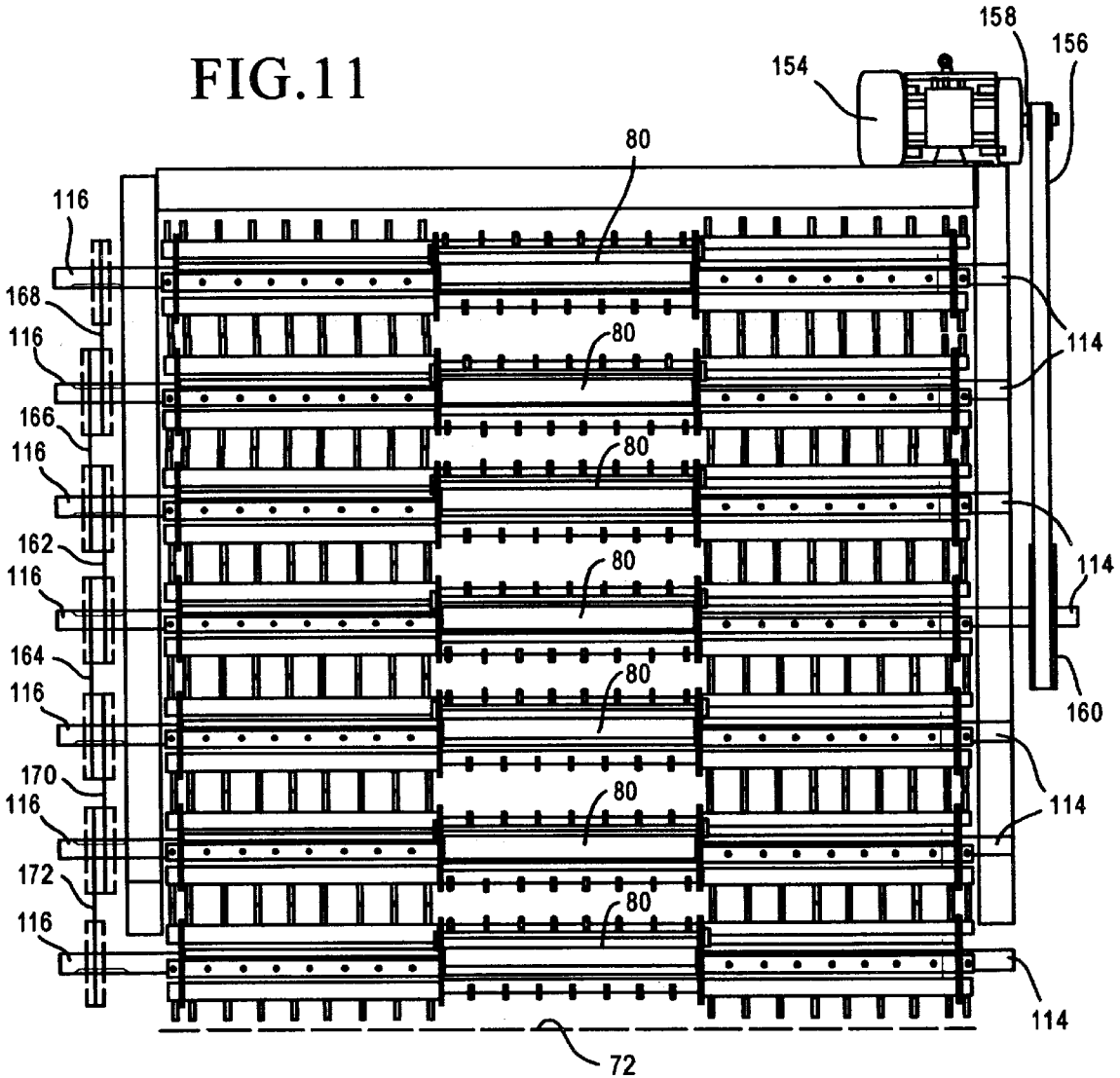
FIG. 11 is a sectional view taken substantially along line 10—10 of FIG. 5, such view including a drive train diagram showing how the disperser rolls are connected to the drive motor.

For each disperser 64, 66, 68, 70 a drive motor 154 is mounted on top of the disperser tunnel. As shown in FIG. 11, a drive belt assembly 156 may connect an output pulley 158 on motor 154 to a pulley 160 that is connected to end shaft 114' of the center disperser roll 80. In the illustrated embodiment, there are seven disperser rolls 80. Thus, there are three disperser rolls 80 above and three disperser rolls 80 below the center disperser roll 40. By way of typical and therefore non-limitive example, the drive belt assembly may comprise five V-belts.

As also shown by FIG. 11, at the opposite ends of the disperser rolls 80, pulleys are connected to the end shaft 116 of the disperser rolls 80. Drive belts 162, 164, 166, 168, 170, 172 interconnect adjacent pulleys. The pulley on end shaft 116 for the center disperser is connected to both the pulley on the end shaft 66 above it and the pulley on the end shaft 66 below it. The connection pattern of the pulleys 162, 164, 166, 168, 170, 172 is shown in FIG. 11. Preferably, the belts are cogged belts or are timing belts. The belt and pulley drive system that is illustrated operates to rotate the disperser rolls 80 in the same direction and at substantially the same speed. The direction may be either clockwise or counterclockwise. The speed may be a variable speed that is determined by the output of motor 154. That is, a variable speed motor 154 may be used. Or, the motor may include a variable speed output transmission.

Figure 12:
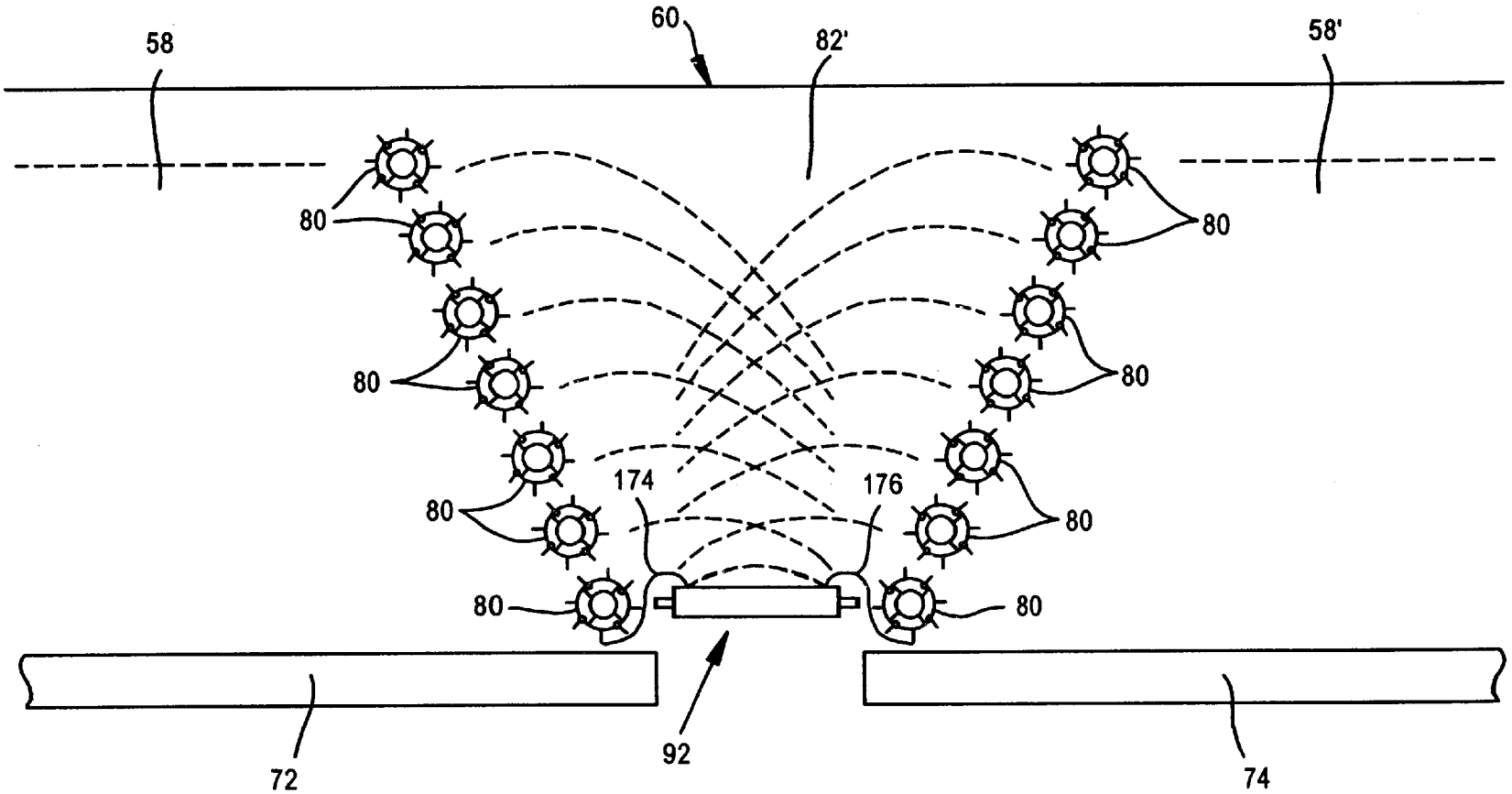
FIG. 12 is a view like FIG. 5, but showing the outfeed conveyor above the floor level.

FIG. 12 is like FIG. 5 except that the outfeed conveyor 92 is elevated above the conveyors 72, 74 or, above the module v support pads in installations that do not have conveyors under the modules. In the FIG. 12 embodiment, the mixing zone sidewalls 86, 88 of FIG. 5 are replaced by sidewalls 174, 176 which are shaped to help direct textile fiber clumps up on to the upper run 50 (not shown) of the conveyor 52, and to also shield against textile fiber clumps dropping between the lowermost disperser rolls 80 and the conveyor 52.

FIG. 13 shows the two disperser tunnels 60, 62 having separate outfeed conveyors 92 directed to convey towards each other. The conveyors 92 discharge the cotton boll clumps onto the upper run 178 of an endless belt conveyor 180. Herein, the term "blend" conveyor is used to designate a conveyor that extends from the outfeed conveyors to the first stage operation in the cleaning and ginning plant. In FIGS. 13 and 14, the conveyor 180 is a first stage mechanical conveyor that delivers the cotton boll clumps to an airstream conveyor 182 having an entry portion 184.

In FIGS. 15 and 16, helical screw type outfeed conveyors 184 are substituted for the endless belt conveyors 52 shown in FIGS. 12 and 13.

FIGS. 17 and 18 show the outfeed conveyors 180 feeding directly to the inlet 186 of an airstream conveyor 188. The inlet structure 188 has branches 190, 192 that are positioned over the discharge end portions 194 and 196 of the conveyors 180. Fans or pumps in the ducting 188 sucks up the cotton boll clumps and moves them on to the cleaning and ginning plant. The air conveyor 182 operates in the same way except the cotton boll clumps are dropped into its inlet structure 184.

Figure 19:
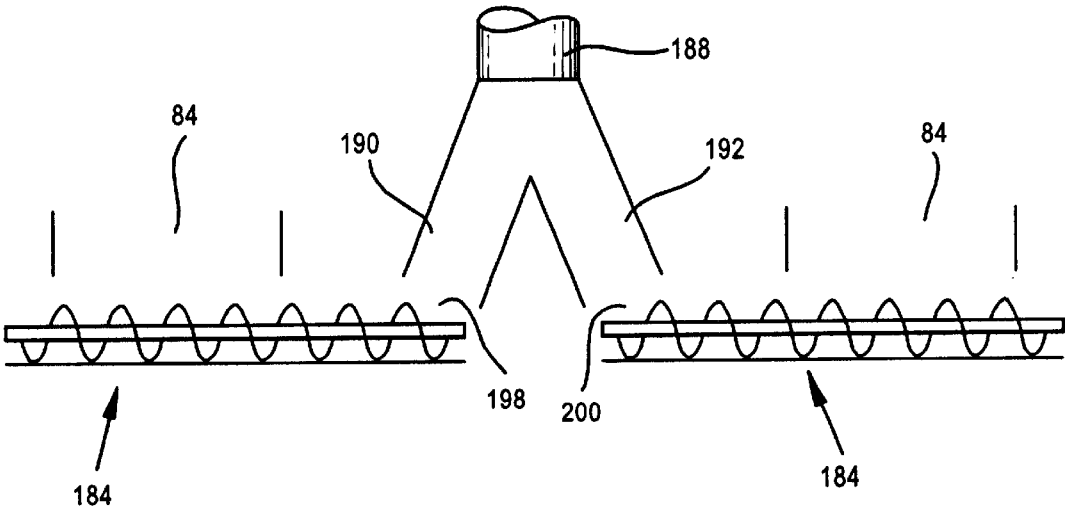
FIG. 19 is a view like FIG. 17, but showing the use of helical screw-type outfeed conveyors.
Figure 20:
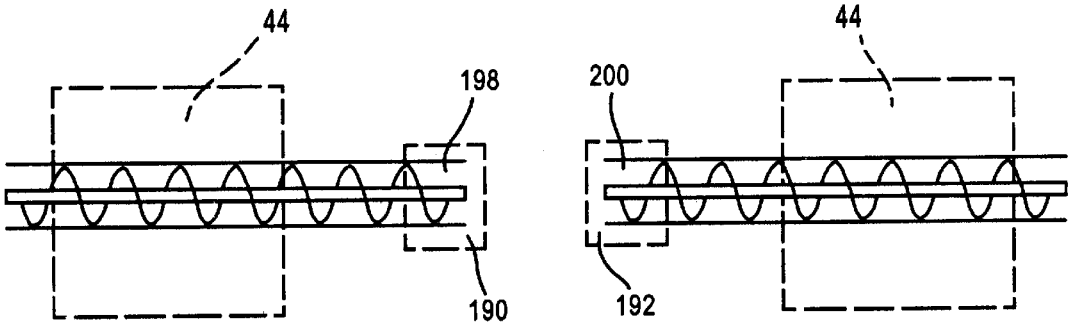
FIG. 20 is a view like FIG. 18, but showing the use of helical screw-type outfeed conveyors.

FIGS. 19 and 20 are like FIGS. 16 and 17 except that the endless belt-type outfeed conveyors 180 are replaced by the helical screw-type outfeed conveyors 184. In this installation, the inlet branches 190, 192 are positioned over the discharge end portions 198, 200 of the conveyors 184. As in the installation described above in connection with FIGS. 16 and 17, the cotton boll clumps are sucked into the ducting 190, 192, 188 and are delivered onto the cleaning and ginning plant.

Figure 21:
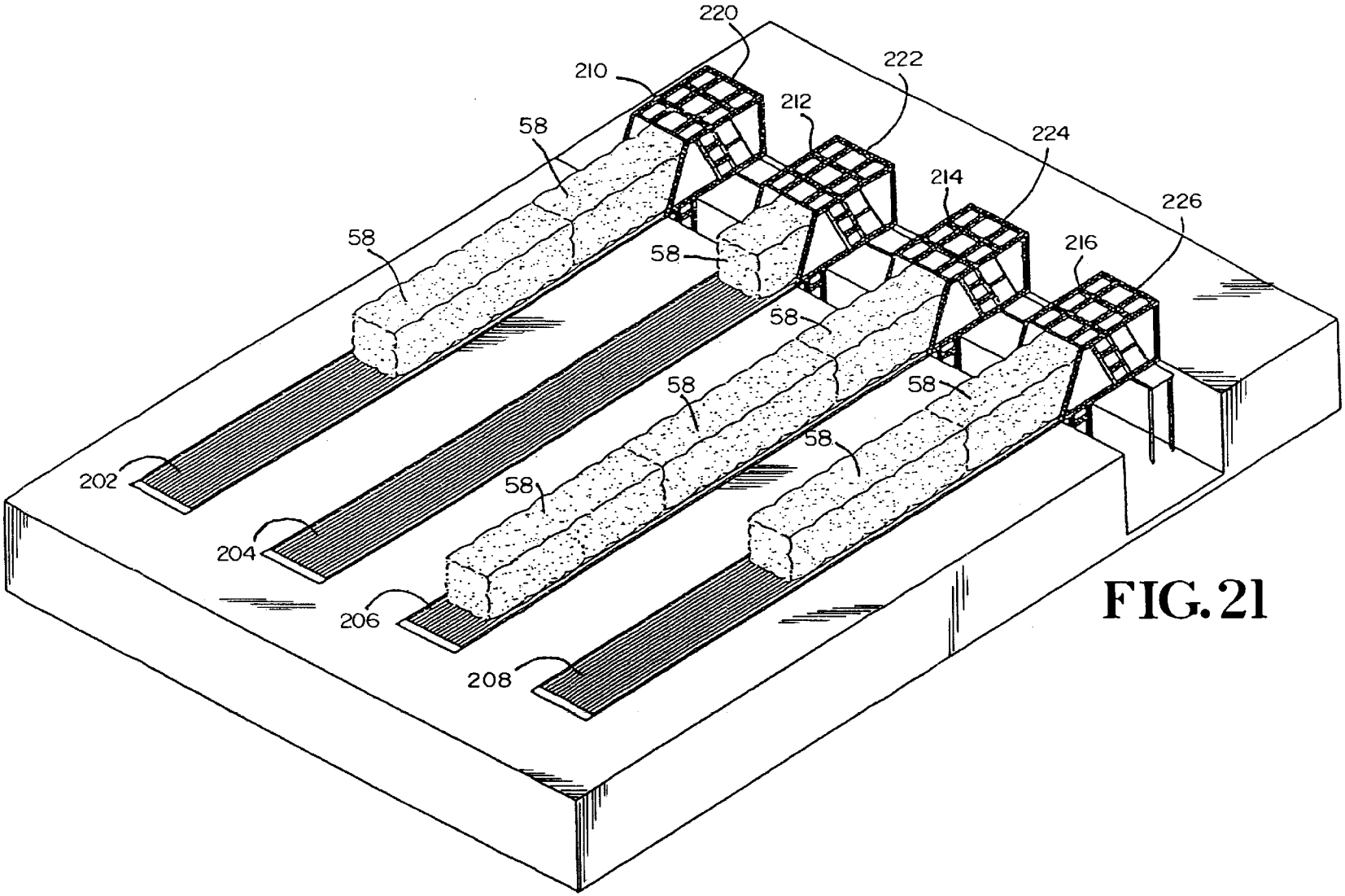
FIG. 21 is a view like FIG. 4, but showing four dispersers positioned side-by-side and further showing a single module feeding conveyor for each disperser.
Figure 22:
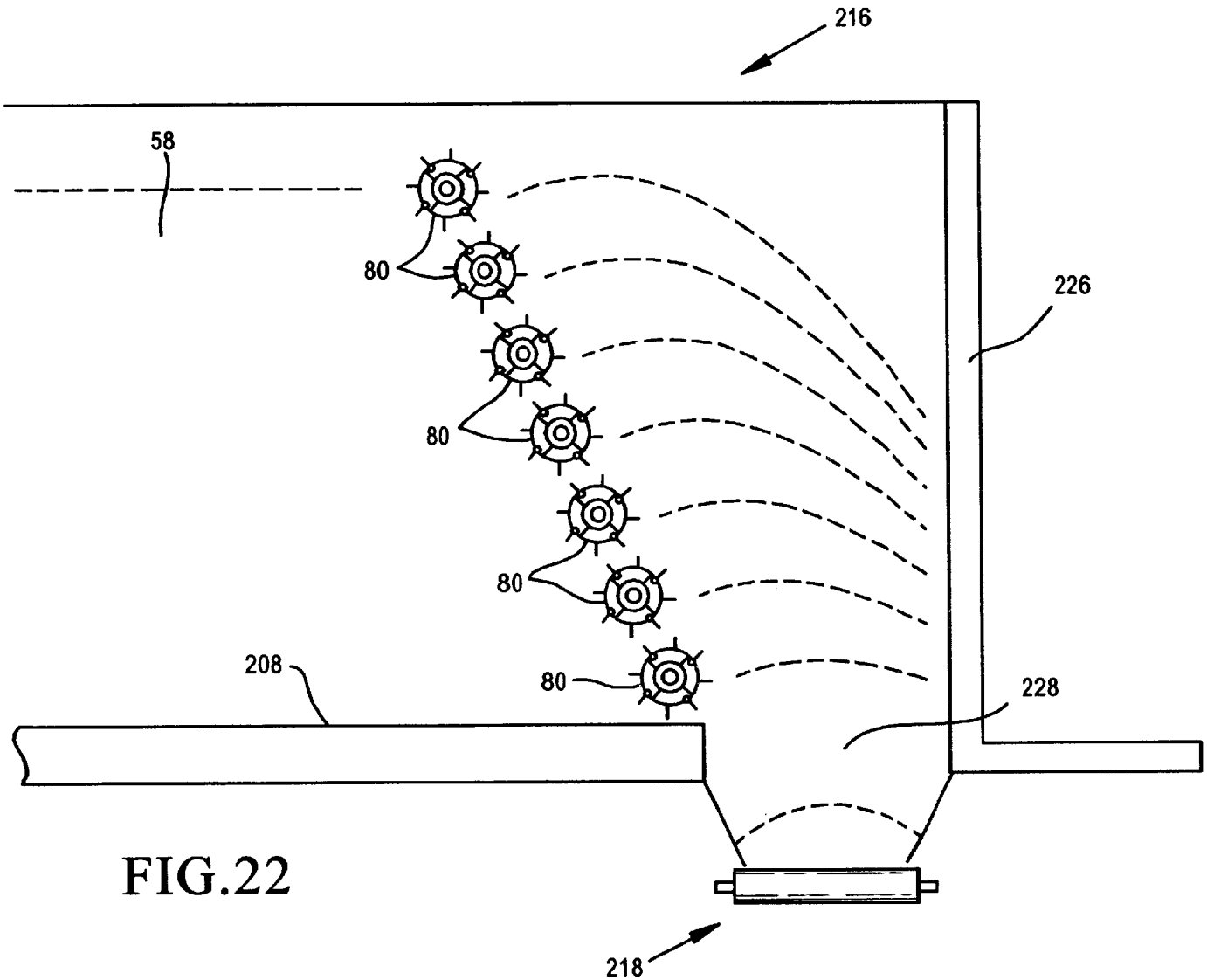
FIG. 22 is a view like FIG. 5, but with respect to the dispersers shown by FIG. 21.

FIG. 21 shows a plurality of infeed conveyors 202, 204, 206, 208 delivering cotton boll modules 58 to a plurality of disperser tunnels 210, 212, 214, 216. In FIG. 21, the infeed conveyors 202, 204, 206, 208 are shown in the form of. reciprocating slat conveyors of the type that has been previously described. FIGS. 21 and 22 show an outfeed conveyor 218 positioned below the level of the tops of the conveyors 200, 204, 206, 208. Each disperser tunnel 210, 212, 214, 216 includes a disperser of the type that has been previously described (e.g. disperser 24). The disperser tunnels 210, 212, 214, 216 include closed end walls 220, 222, 224, 226. The cotton boll clumps are discharged by the disperser rolls 80 into a cotton boll collecting zone 228. A single outfeed conveyor 218 may extend through all of the collection zones 228, in series. Or, disperser tunnels 210, 212 may have a first outfeed conveyor and disperser tunnels 214, 216 may have a second outfeed conveyor, with the outfeed conveyors conveying towards each other and to a common discharge location that is between disperser tunnels 212, 214. Other arrangements may be used as well.

Figure 23:
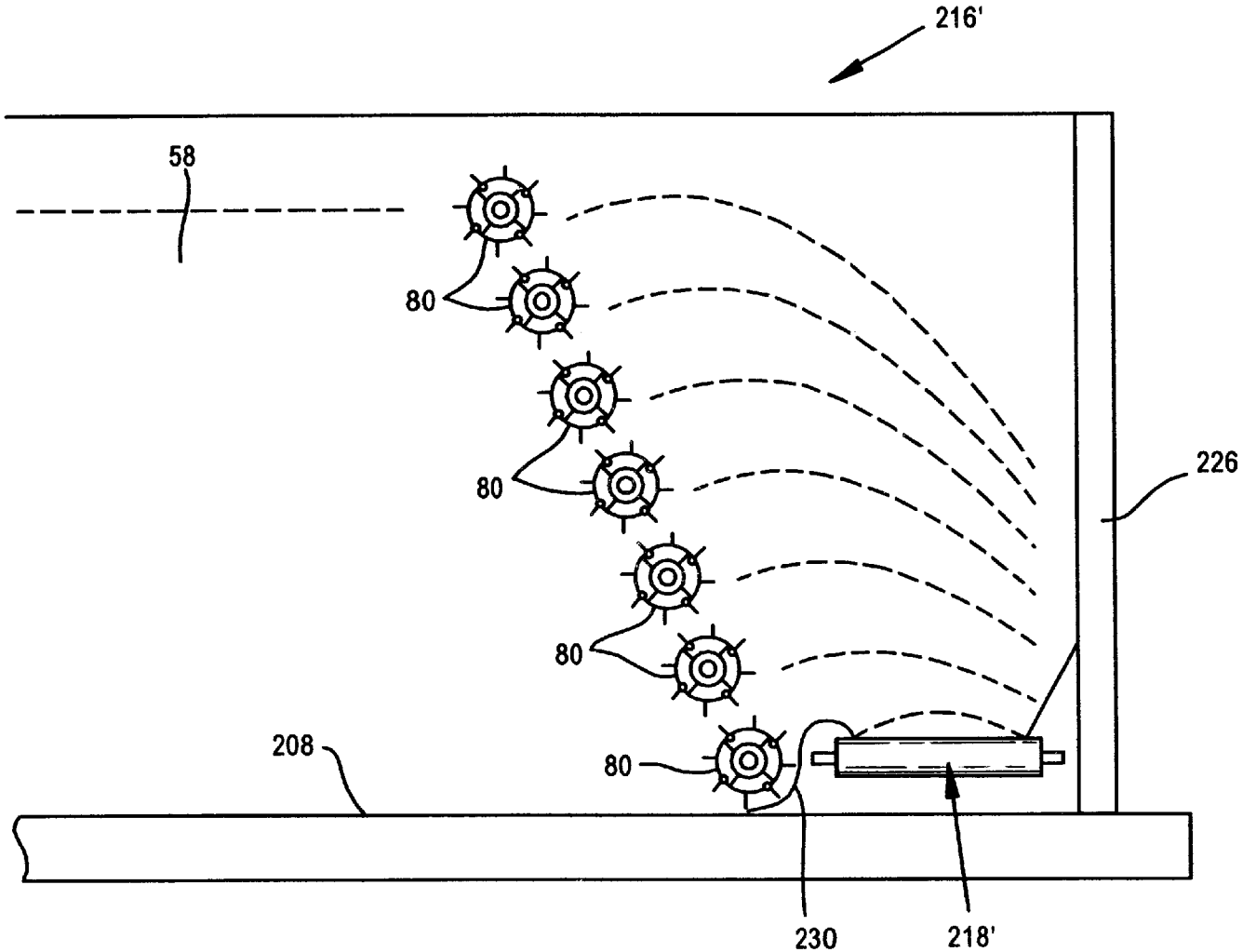
FIG. 23 is a view like FIG. 12, but with respect to the disperser shown by FIG. 22.

FIG. 23 is like FIG. 22 except that the outfeed conveyor 218 is elevated to a position above the top surface of the conveyor 208, or the top surface of a pad on which the module sits in installations which do not have a conveyor below the modules 18. The embodiment of FIG. 23 includes a barrier 230 that helps guide cotton boll clumps up onto the upper run of the conveyor 218' and to also block against downward movement of cotton boll clumps between the lowest disperser roller 80 and the conveyor 218'.

FIGS. 24 and 25 show a single outfeed conveyor 218 that runs through all four cotton boll clump collection zones and delivers the cotton boll clumps into the inlet 230 of an airstream conveyor 232. In FIGS. 24 and 25, the outfeed conveyor 218 is broken away so as to show the entrance 228 for the outfeed conveyor 218 that is located in the first disperser tunnel 210, and show the airstream conveyor ducting 230, 230 positioned to receive cotton boll clumps from the conveyor 218.

Figure 26:
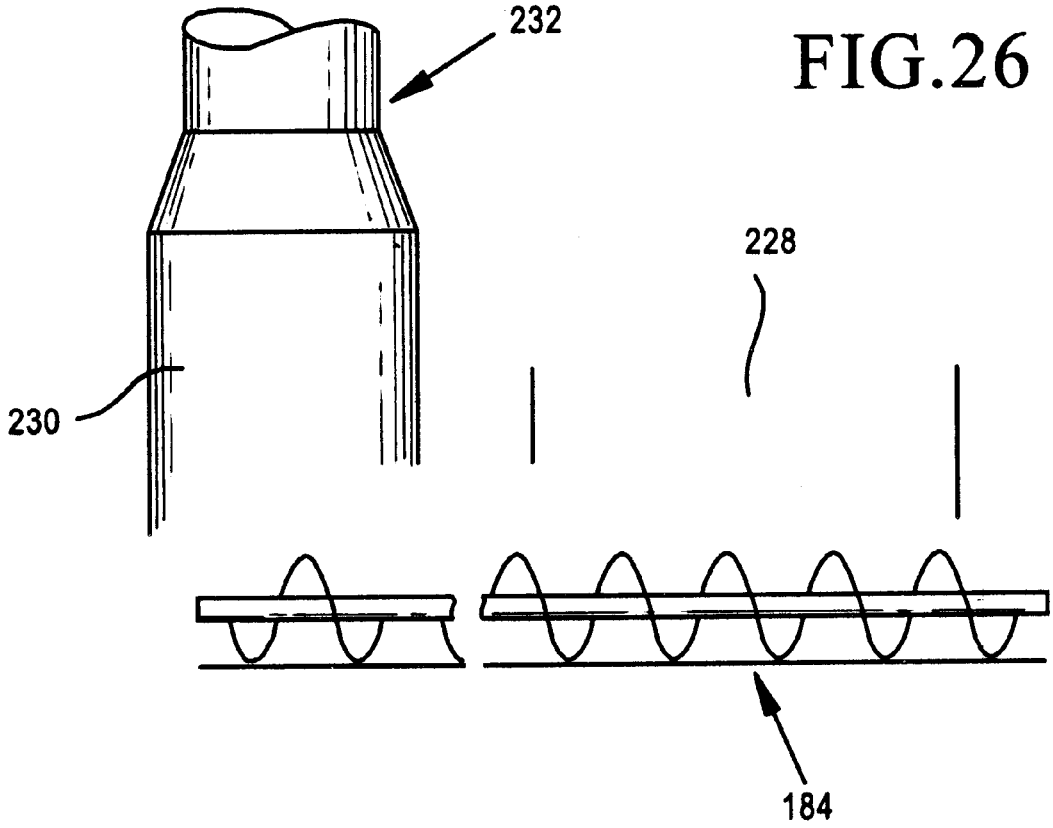
FIG. 26 is a view like FIG. 24, but showing a helical screw-type outfeed conveyor.
Figure 27:
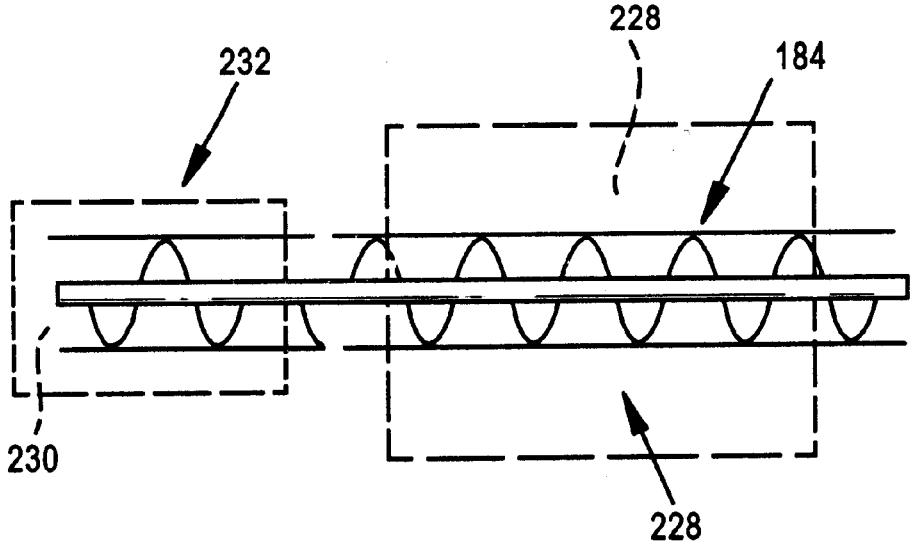
FIG. 27 is a view like FIG. 25, but showing a helical screw-type outfeed conveyor.

FIGS. 26 and 27 are like FIGS. 23 and 24 but show a helical screw conveyor 184 substituted for the endless belt conveyor 218. The conveyor 184 is cut away so as to show the beginning portion of it that is within the disperser tunnel 210 and to show the discharge portion of it that is downstream of the disperser tunnel 226, below the inlet structure 230 of the airstream conveyor 232.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A method of processing cotton, comprising:

receiving a plurality of cotton boll modules from a plurality of cotton field locations, each field location producing a field lot;

selecting a sample of cotton modules from each field lot;

identifying each sample and the field lot from which it came and generating identification data associating the sample with its field lot;

separately processing each field lot sample to produce cotton lint;

assaying the cotton lint to determine a relative quality of the lint in each field lot sample;

using the assay information to establish a formula for blending cotton boll clumps from a plurality of field lots of different quality to form a cotton boll blend of a desired intermediate quality;

using the identification data for locating modules to be blended from the field lots;

introducing the located modules into dispersers and using the dispersers to disperse cotton boll clumps from the modules in amounts necessary to form a desired amount of a desired blend of cotton boll clumps;

mixing the cotton boll clumps dispersed from said modules to form a blend of cotton boll clumps;

cleaning and ginning the blend of cotton boll clumps to form a cotton lint blend; and said method including positioning first and second dispersers at a disperser station, each having an input side and an output side;

operating the first and second dispersers while feeding a first cotton boll module against the first disperser and feeding a second cotton boll module against the second disperser;

operating said first and second dispersers so that each will disperse cotton boll clumps from its module; and providing each disperser with an infeed conveyor, removing the selected modules and placing them onto the infeed conveyors, and controlling the conveying speed of the infeed conveyors so as to control the dispersion rate of the cotton boll clumps and the content of the blend.

2. The method of claim 1, comprising storing the identified field lots of cotton boll modules until the modules are selected to form a desired cotton lint blend.

3. The method of claim 2, comprising removing the selected modules from storage and then dispersing them to form cotton boll clumps, and then blending, cleaning and ginning the cotton boll clumps, after and in response to receipt of an order for a desired cotton lint blend from a customer.

4. The method of claim 3, further comprising delivering the cotton lint blend to the customer, substantially immediately following its production.

5. The method of claim 1, comprising dispersing the modules at a disperser station at a ginning plant, and using a conveyor for delivering and further blending the cotton boll clumps as they are moved from the disperser station to cleaning units and at least one cotton gin in the ginning plant.

6. The method of claim 1, comprising positioning at least one pair of first and second confronting dispersers at the disperser station, each having an input side and an output side, wherein said output sides face each other on opposite sides-of a mixing zone;

operating the first and second dispersers while feeding a first cotton boll module against the input side of the first disperser and feeding a second cotton boll module against the input side of the second disperser;

operating said first and second dispersers so that each will disperse cotton boll clumps from its module and deliver them airborne into the mixing zone in admixture with airborne cotton boll clumps entering the mixing zone from the other disperser of the pair; and collecting the mixture of cotton boll clumps and conveying it away from the disperser station into and through the cleaning and ginning operation.

7. The method of claim 6, comprising using an airstream conveyor for conveying the blend of cotton boll clumps during at least a part of their travel from the disperser station to the cleaning and ginning operation, so that the cotton boll clumps are fluidized and further blended as they are being conveyed.

8. The method of claim 7, comprising storing the identified field lots of cotton boll modules until it is desired to form a particular cotton lint blend and then selecting cotton boll modules from the identified lots in storage and moving them to the dispersing station and dispersing them at said station.

9. The method of claim of 1, comprising providing each disperser with a reciprocating slat type infeed conveyor, removing the selected modules from storage and placing them onto the infeed conveyors, and controlling conveying speed of the infeed conveyors so as to control the dispersion rate of the cotton boll clumps and content of the blend.

10. The method of claim 1, comprising storing the field lots of modules at a module storing location that is a part of the ginning plant, and dispersing the modules at a disperser station that is also a part of the ginning plant.

11. The method of claim 10, comprising using a conveyor for delivering and further blending the cotton boll clumps as they are moved from the disperser station to cleaning units and cotton gins in the ginning plant.

12. The method of claim 11, comprising further mixing and blending the cotton boll clumps in the cleaning units.

13. The method of claim 12, comprising further blending the cotton boll clumps in the cotton gin.

14. The method of claim 13, comprising storing the identified field lots of cotton boll modules until modules from the different field lots are selected to form a cotton lint blend and then moving the selected modules from storage to the dispersers.

15. The method of claim 14, comprising removing the selected modules from storage and then dispersing them to form cotton boll clumps, and then blending, cleaning and ginning the cotton boll clumps after and in response to receipt of an order for a desired cotton lint blend from a customer.

16. The method of claim 15, further comprising delivering the cotton lint blend to the customer, substantially immediately following its production.

17. The method of claim 1, comprising positioning a third disperser at the disperser station, said third disperser having an input side and an output side;

operating the third disperser while feeding a third cotton boll module against the input side of the third disperser;

operating said third disperser so that it will disperse cotton boll clumps from its module; and collecting the dispersed cotton boll clumps and blending them with the cotton boll clumps from the first and second dispersers.

18. The method of claim 1, comprising dispersing cotton boll clumps from the first and second dispersers onto at least one conveyor and conveying the cotton boll clumps to a mixing region.

19. The method of claim 18, comprising collecting the blend of cotton boll clumps and moving them into and through a cleaning and ginning operation.

20. The method of claim 1, comprising using the cotton lint produced by processing the field lot samples to establish a market price for each field lot.

21. The method of claim 20, comprising utilizing the market price information to help establish a formula for blending cotton from the various field lots.

22. The method of claim 20, comprising storing the identified field lots of cotton boll modules until the modules are selected to form a desired cotton lint blend.

23. The method of claim 22, comprising removing the selected modules from storage and then dispersing them to form cotton boll clumps, and then blending, cleaning and ginning the cotton boll clumps after and in response to receipt of an order for a desired cotton lint blend from a customer.

24. The method of claim 23, further comprising delivering the cotton lint blend to the customer, substantially immediately following its production.

25. A method of processing cotton, comprising:

receiving a plurality of cotton boll modules from a plurality of cotton field locations, each field location producing a field lot;

selecting a sample of cotton modules from each field lot;

identifying each sample and the field lot from which it came and generating identification data associating the sample with its field lot;

separately processing each field lot sample to produce cotton lint;

assaying the cotton lint to determine a relative quality of the lint in each field lot sample;

using the assay information to establish a formula for blending cotton boll clumps from a plurality of field lots of different quality to form a cotton boll blend of a desired intermediate quality;

using the identification data for locating modules to be blended from the field lots;

introducing the located modules into dispersers and using the dispersers to disperse cotton boll clumps from the modules in amounts necessary to form the desired amount of the desired blend of cotton boll clumps;

mixing the cotton boll clumps dispersed from said modules to form a blend of cotton boll clumps;

cleaning and ginning the blend of cotton boll clumps to form a cotton lint blend; and storing the identified field lots of cotton boll modules until the modules are selected to form a desired cotton lint blend the removing the selected modules from storage, and then dispersing them to form cotton boll clumps, and then blending, cleaning and ginning the cotton boll clumps after and in response to receipt of an order for a desired cotton lint lend from a customer.

26. The method of claim 25, comprising dispersing cotton boll clumps from first and second dispersers onto at least one conveyor and conveying the cotton boll clumps to a mixing region.

27. The method of claim 26, comprising collecting the lend of cotton boll clumps and moving them into and through a leaning and ginning operation.

28. The method of claim 25, comprising using the cotton lint produced by processing the field lot samples to establish a market price for each field lot, and utilizing the market price information to help establish a formula for blending cotton from the various field lots.

* * * * *